US008459647B2

(12) United States Patent
Ferron

(10) Patent No.: US 8,459,647 B2
(45) Date of Patent: Jun. 11, 2013

(54) GAME HAVING ADVERSARIAL FIGURE RELEASABLY HOLDING A PLAYER FIGURE

(75) Inventor: Robert William Ferron, Kansas City, MO (US)

(73) Assignee: Tangerine Creative, LLC, Kansas City, MO (US)

( * ) Notice: Subject to any disclaimer, the term of this patent is extended or adjusted under 35 U.S.C. 154(b) by 0 days.

(21) Appl. No.: 12/826,503

(22) Filed: Jun. 29, 2010

(65) Prior Publication Data

US 2011/0074105 A1 Mar. 31, 2011

Related U.S. Application Data

(60) Provisional application No. 61/247,371, filed on Sep. 30, 2009.

(51) Int. Cl.
*A63F 3/00* (2006.01)

(52) U.S. Cl.
USPC ..... 273/255; 273/262; 446/310

(58) Field of Classification Search
USPC ..... 273/255, 262, 288; 446/72, 73, 310, 446/311
See application file for complete search history.

(56) References Cited

U.S. PATENT DOCUMENTS

| | | | | | |
|---|---|---|---|---|---|
| 687,487 | A | * | 11/1901 | Powell | 273/281 |
| 1,445,368 | A | * | 2/1923 | Street et al. | 446/73 |
| 1,534,522 | A | * | 4/1925 | Halliday | 273/118 D |
| 2,036,802 | A | * | 4/1936 | Fleishman et al. | 446/423 |
| 2,476,580 | A | * | 7/1949 | Bergman | 434/206 |
| 3,660,930 | A | * | 5/1972 | Indjian | 446/297 |
| D226,101 | S | * | 1/1973 | Marcus | D21/590 |
| 3,787,052 | A | | 1/1974 | Glass et al. | |
| 3,794,325 | A | | 2/1974 | Stender | |
| 3,951,329 | A | | 4/1976 | Turner | |
| 3,980,198 | A | | 9/1976 | Baumgarten | |
| 4,039,188 | A | | 8/1977 | Goldfarb et al. | |
| 4,125,262 | A | * | 11/1978 | Erickson | 273/334 |
| 4,134,592 | A | * | 1/1979 | Pullman | 273/281 |
| 4,157,182 | A | * | 6/1979 | Levine | 463/52 |
| 4,184,680 | A | * | 1/1980 | Gage | 273/356 |
| 4,194,318 | A | * | 3/1980 | Watanabe | 446/435 |
| 4,197,670 | A | * | 4/1980 | Cox | 446/369 |
| 4,237,649 | A | * | 12/1980 | Goldfarb et al. | 446/330 |

(Continued)

OTHER PUBLICATIONS

Creative Tangerine, LLC; Various conflict resolution, figure confrontation dexterity games, anti bullying games, prisoner games, remote controlled battle games, target games, min figure battle games, and action figure toys that are in the marketplace (dated May 14, 2010).

*Primary Examiner* — Vishu K. Mendiratta
(74) *Attorney, Agent, or Firm* — Hovey Williams LLP

(57) ABSTRACT

A game includes an adversarial figure with at least two portions that cooperatively present a figure-holding chamber. A captured figure is removably positioned in the chamber and operable to enter and exit the chamber. The holding figure also has a latch assembly that holds the portions in a closed condition where figure ingress and egress is restricted. The latch assembly can be shifted to open the portions and permit figure ingress and egress to and from the chamber. The game has an objective of freeing the captured figure from within the chamber by having a player position a rescuing figure in a game area, and releasing the captured figure from control of the holding figure as a result of a releasing act of the rescuing figure.

9 Claims, 22 Drawing Sheets

U.S. PATENT DOCUMENTS

| | | | | | |
|---|---|---|---|---|---|
| 4,245,842 | A | * | 1/1981 | Kuna et al. | 273/357 |
| 4,534,567 | A | * | 8/1985 | Ferris et al. | 273/255 |
| 4,639,234 | A | | 1/1987 | Atwood | |
| 4,708,683 | A | * | 11/1987 | Lehmann et al. | 446/75 |
| 4,710,146 | A | | 12/1987 | Rasmussen et al. | |
| 4,740,187 | A | * | 4/1988 | Rasmussen et al. | 446/73 |
| 4,826,176 | A | | 5/1989 | Kobayashi | |
| 5,009,424 | A | | 4/1991 | Harth et al. | |
| 5,344,156 | A | | 9/1994 | Levin | |
| 5,803,455 | A | | 9/1998 | Falzarano | |
| 6,280,286 | B1 | | 8/2001 | Andrews | |
| 6,332,616 | B1 | | 12/2001 | Brown | |
| 6,824,442 | B2 | | 11/2004 | Andrews et al. | |
| 6,837,769 | B1 | | 1/2005 | Skov et al. | |
| 6,937,152 | B2 | * | 8/2005 | Small | 340/568.1 |
| 7,077,400 | B2 | * | 7/2006 | Kenney | 273/242 |
| 7,104,543 | B2 | | 9/2006 | Wilk et al. | |
| 7,222,859 | B2 | | 5/2007 | Mitvalsky | |
| 7,296,796 | B2 | | 11/2007 | Mackenzie | |
| 2008/0023923 | A1 | * | 1/2008 | Kameyama et al. | 277/595 |
| 2009/0174142 | A1 | * | 7/2009 | Sullivan | 273/272 |

* cited by examiner

GAME HAVING ADVERSARIAL FIGURE RELEASABLY HOLDING A PLAYER FIGURE

RELATED APPLICATION

This application claims the benefit of U.S. Provisional Application Ser. No. 61/247,371, filed Sep. 30, 2009, entitled GAME HAVING ADVERSARIAL FIGURE RELEASABLY HOLDING A PLAYER FIGURE, which is hereby incorporated in its entirety by reference herein.

BACKGROUND

1. Field

The present invention relates generally to games. More specifically, embodiments of the present invention concern a game where a player attempts to free a captured game piece from an adversary.

2. Discussion of Prior Art

Games that are played with handheld figures where a player confronts and attempts to defeat an adversarial figure are well known. Conventional games are known to provide the player with multiple options during game play and serve to challenge the player's ability to choose successful game play tactics. Some of the prior art games are also configured to be played by players of various ages, particularly children. Prior art adversarial games also involve the use of objects that are thrown or propelled as part of game play to test the player's hand and eye coordination.

Prior art games as discussed above suffer from various undesirable limitations. For instance, prior art games fail to provide game play that fairly challenges both mental skill and manual dexterity of children. Additionally, the prior art games fail to test mental skill and manual dexterity consistently throughout the course of the game. Conventional games also generally encourage violent or destructive game play, such as where rules allow a player to kill or otherwise overpower an opposing figure, to win the game.

SUMMARY

The following brief summary is provided to indicate the nature of the subject matter disclosed herein. While certain aspects of the present invention are described below, the summary is not intended to limit the scope of the present invention.

Embodiments of the present invention provide a game that does not suffer from the problems and limitations of the prior art games set forth above.

A first aspect of the present invention concerns a game assembly that broadly includes a holding figure and a captured figure. The holding figure includes at least two portions that cooperatively present a chamber. The captured figure is removably positioned in the chamber and is operable to enter and exit the chamber. The at least two portions are movable relative to one another to define open and closed conditions. The at least two portions restrict figure ingress and egress relative to the chamber in the closed condition and permit figure ingress and egress relative to the chamber in the open condition. The holding figure further includes a latch assembly shiftable into and out of a latching position where the latch assembly releasably secures the portions in the closed condition. The latch assembly includes a target configured to be actuated by an object and thereby release the latch assembly from the latching position when actuated so as to permit the portions to move into the open condition.

A second aspect of the present invention concerns a method of playing an adversarial game with an objective of freeing a captured gamepiece from within a chamber defined by a holding gamepiece. The method broadly includes the steps of having a player position a rescuing gamepiece in a game area, and releasing the captured gamepiece from control of the holding gamepiece as a result of a releasing act of the rescuing gamepiece.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 1:
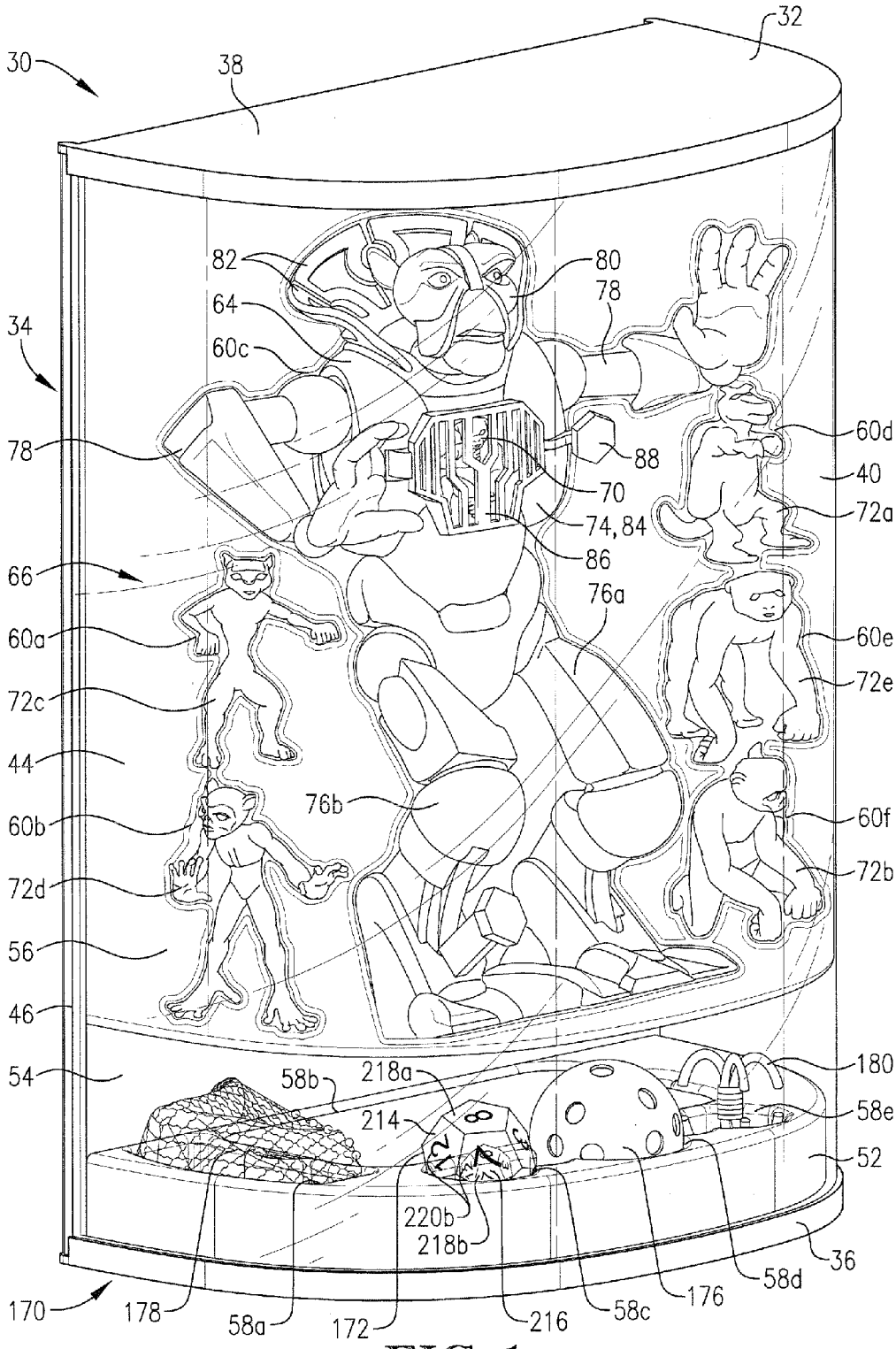
FIG. 1 is a perspective of a game assembly constructed in accordance with a first embodiment of the present invention, showing a container and game components housed in the container, with the game components including a holding figure, squad members, dice, net, grapple, and ball as shown.
Figure 2:
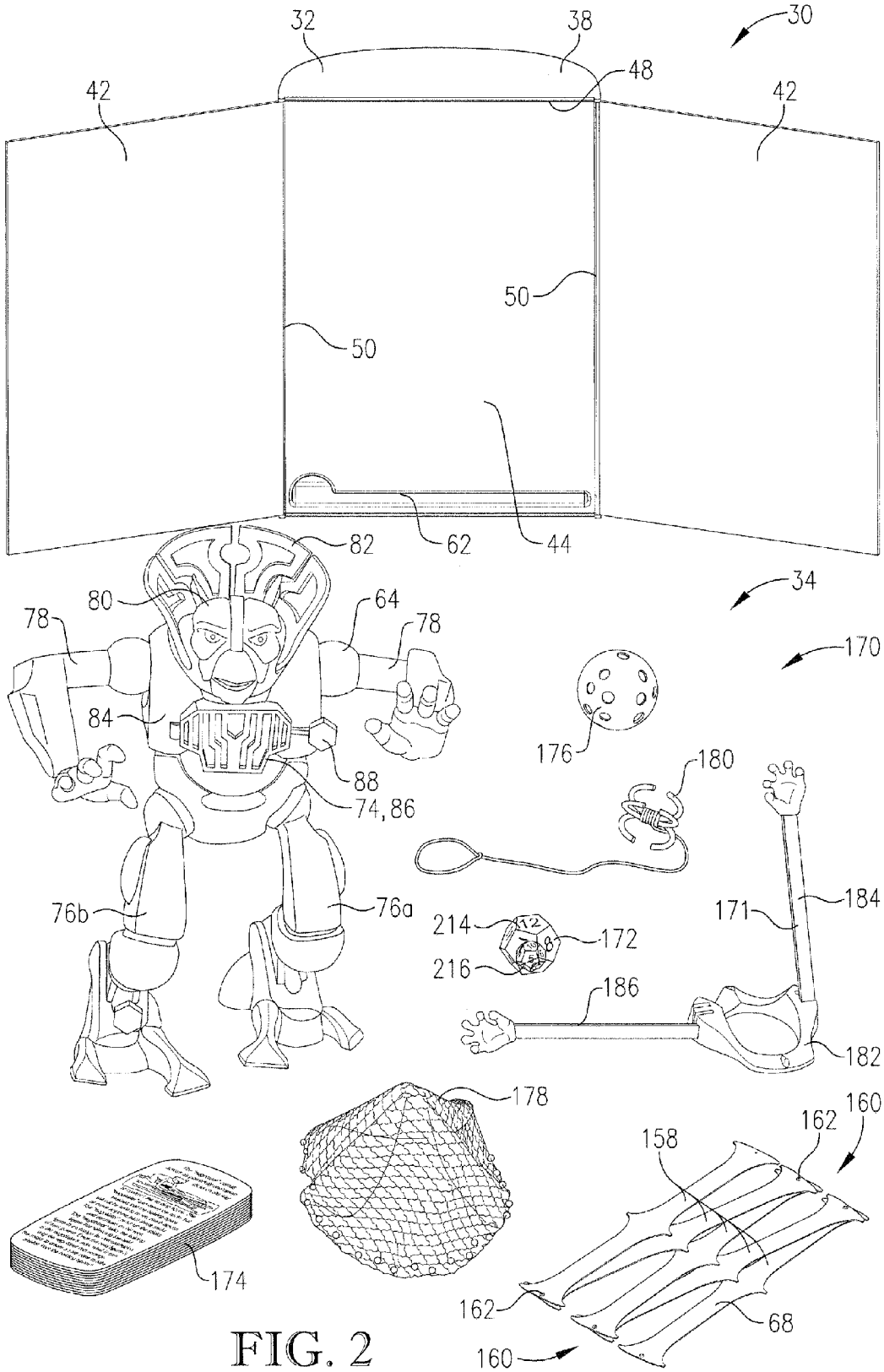
FIG. 2 is a perspective of the game assembly shown in FIG. 1, showing the components removed from the container and the container arranged with container doors open, with the game components including a holding figure, launcher, movement indicator, and card set as shown, and also showing the dice, net, grapple, and ball.
Figure 3:
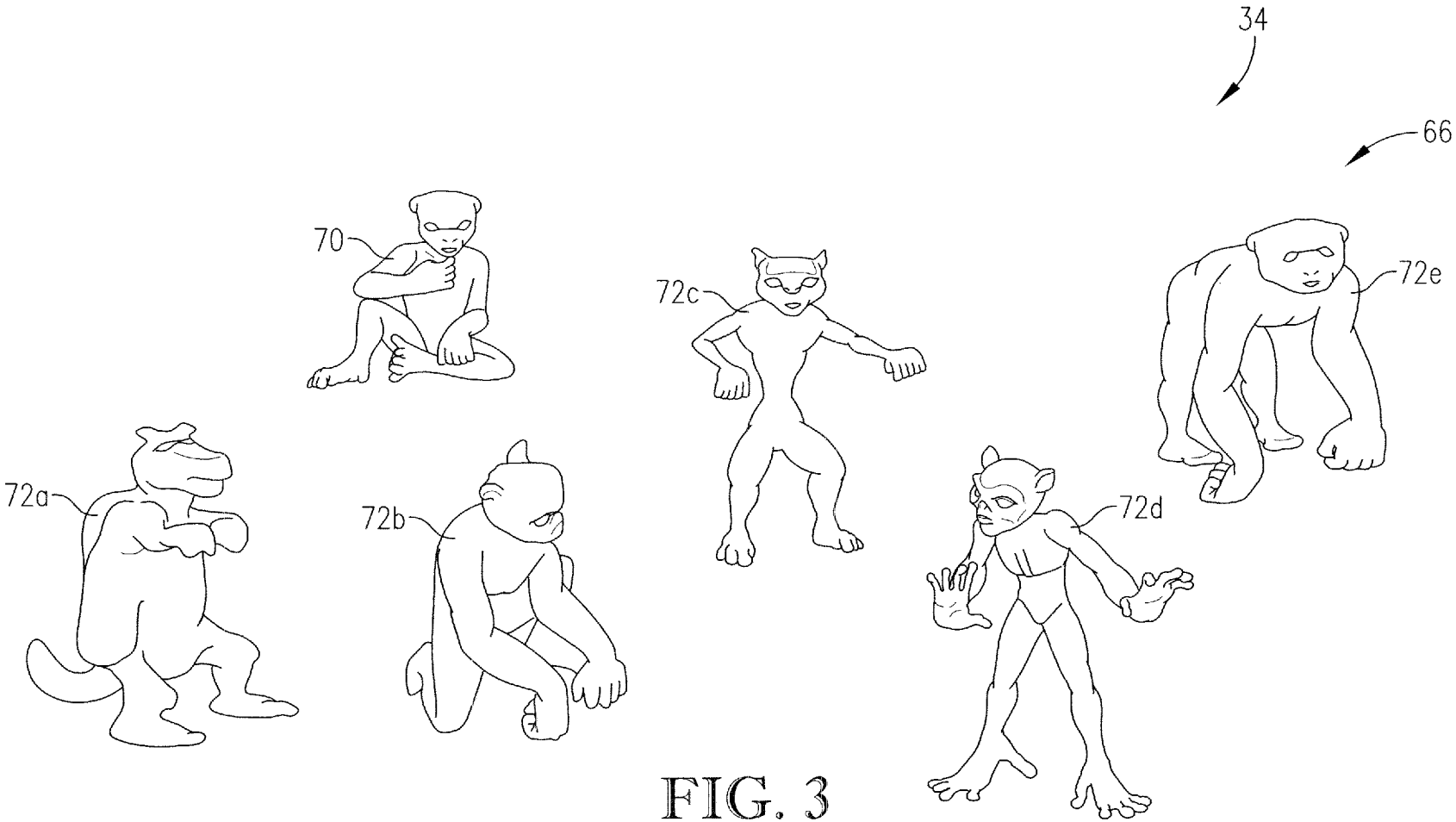
FIG. 3 is a perspective of the squad members shown in FIG. 1, with the squad members including a captured figure and rescuing figures.
Figure 4:
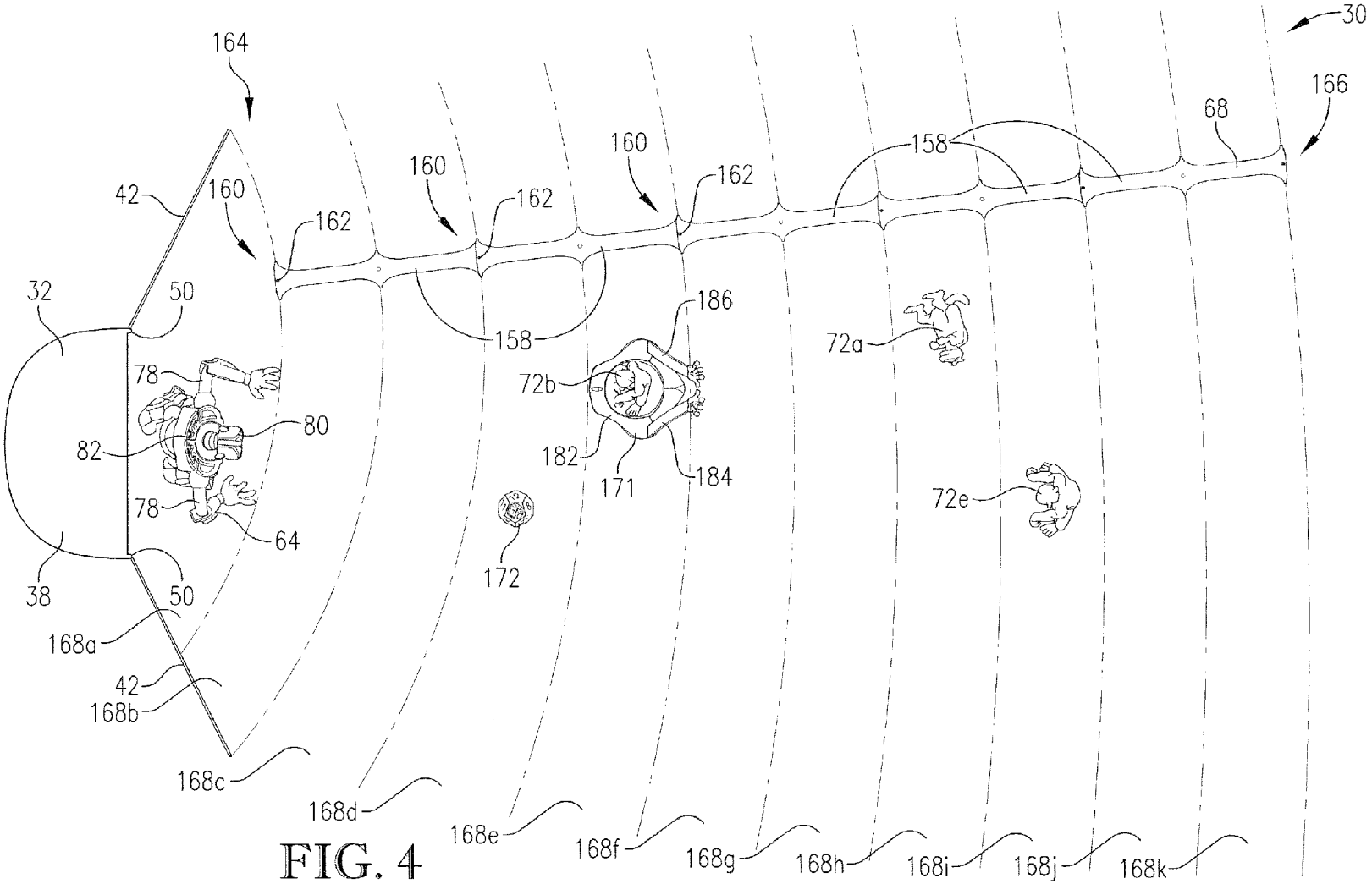
Figure 5A:
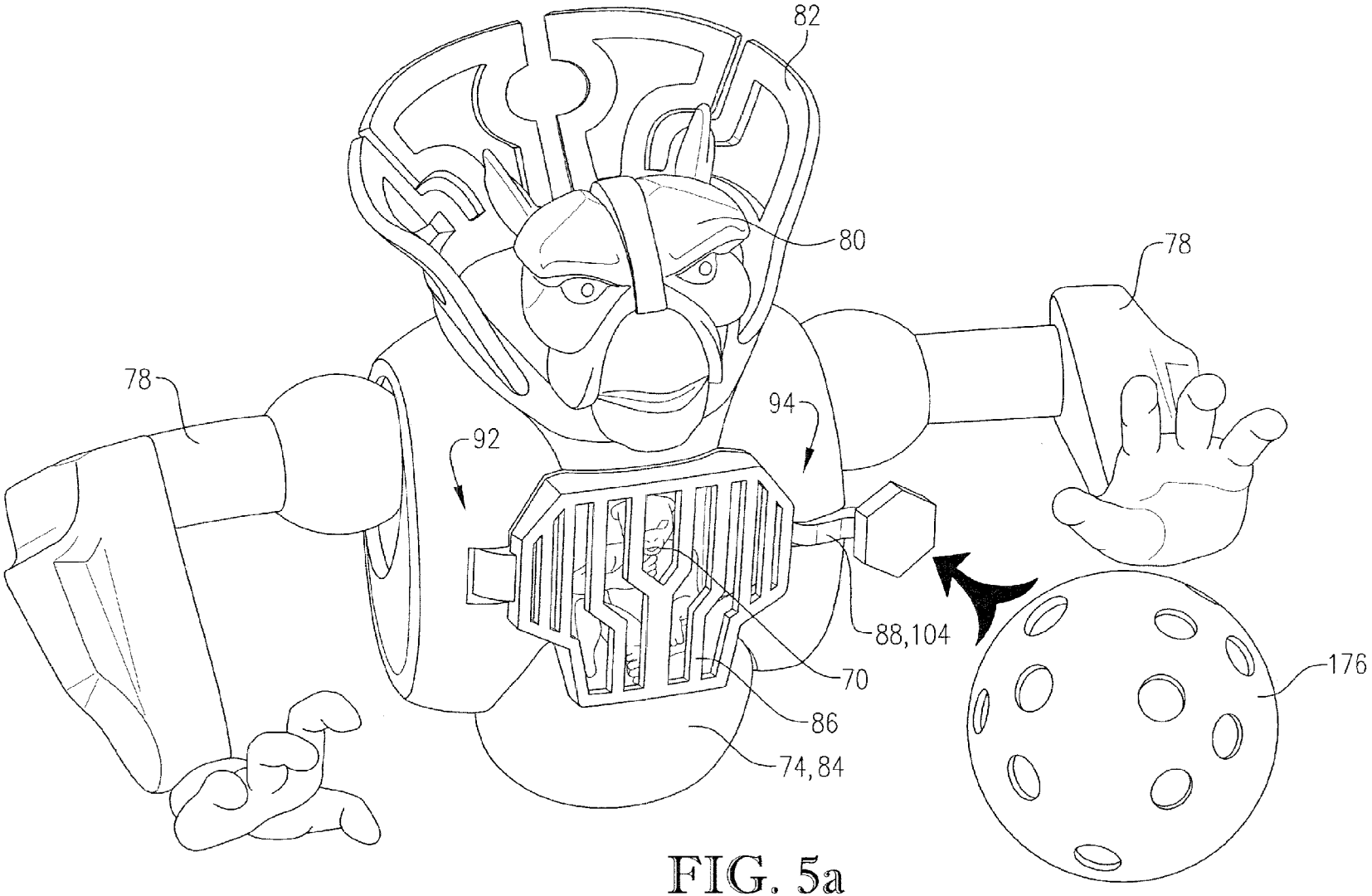
Figure 5B:
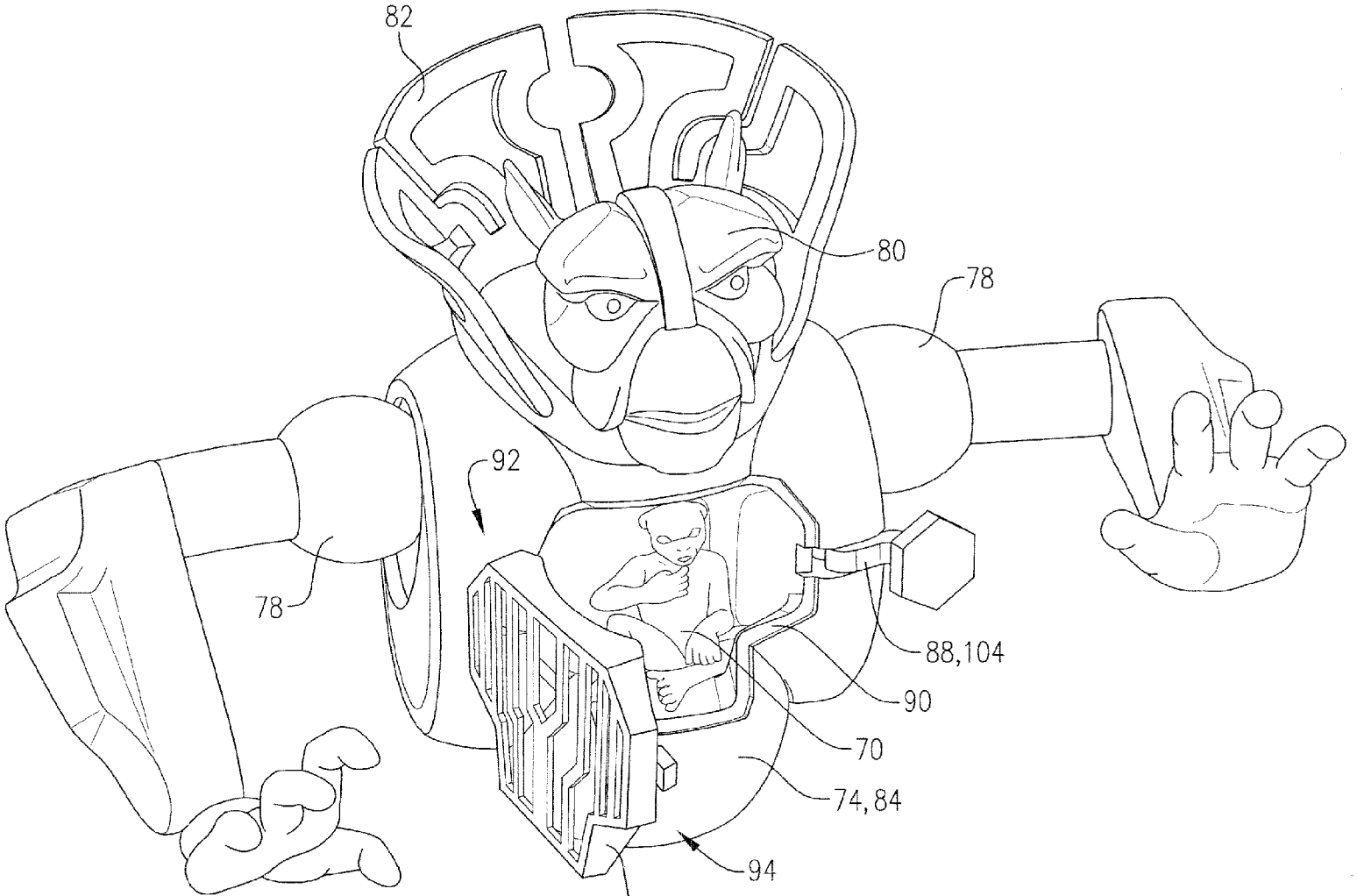
Figure 6A:
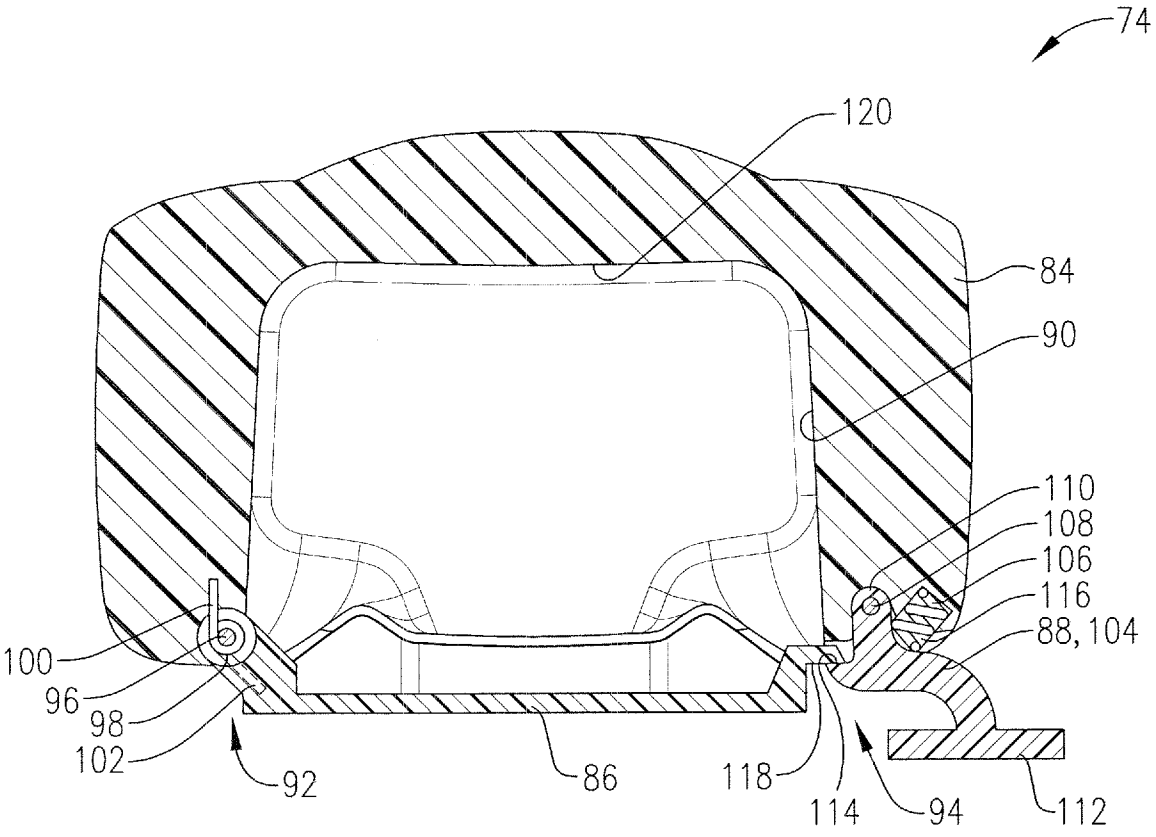
Figure 6B:
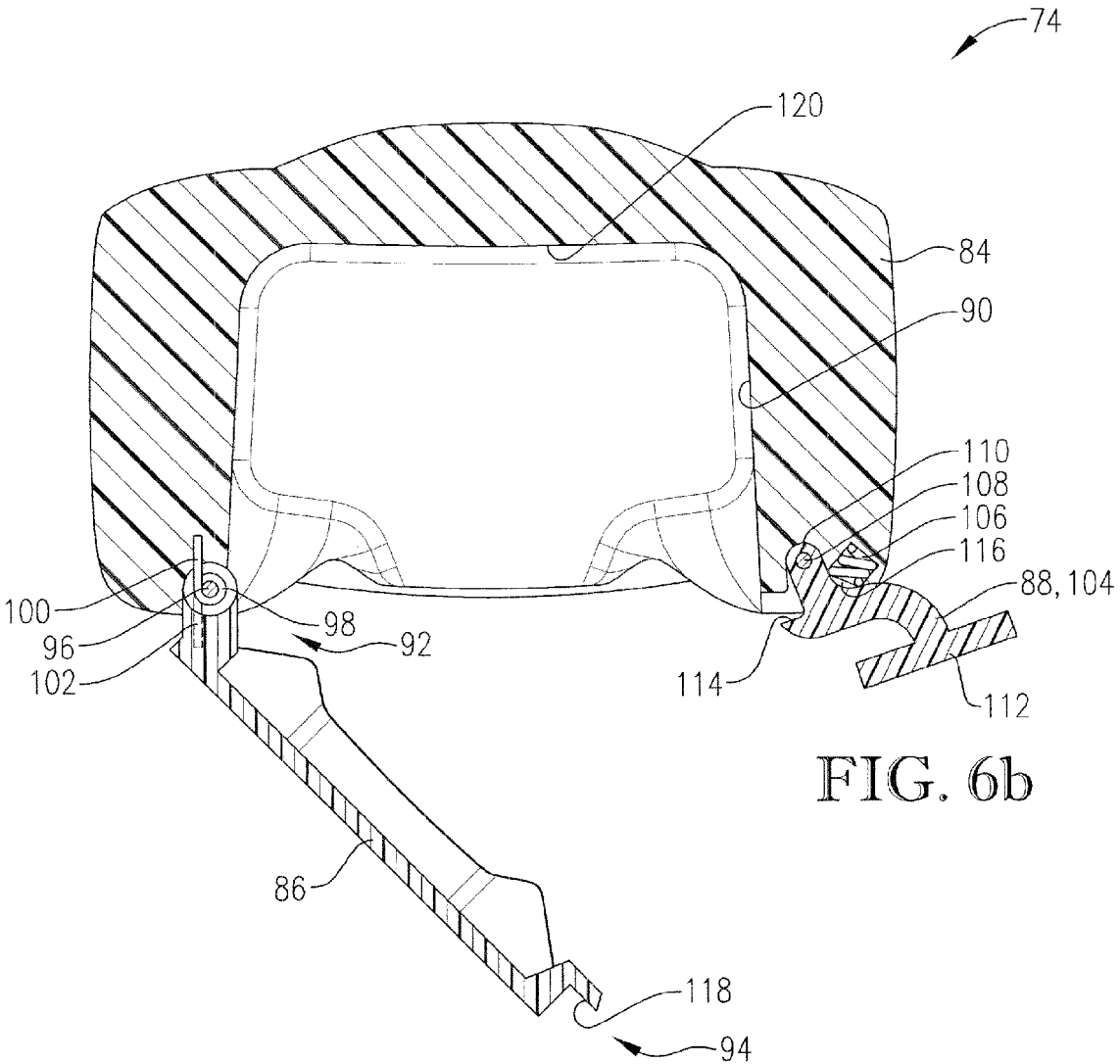
Figure 7B:
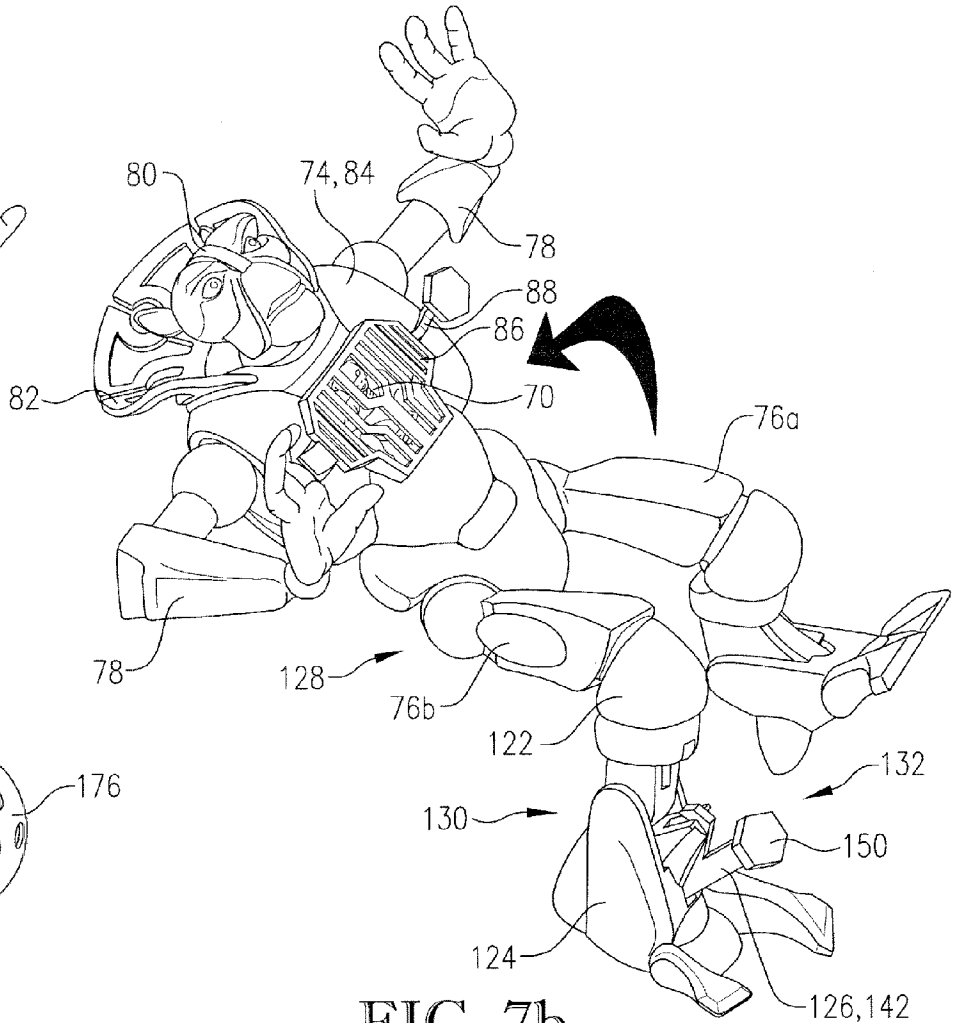
Figure 7A:
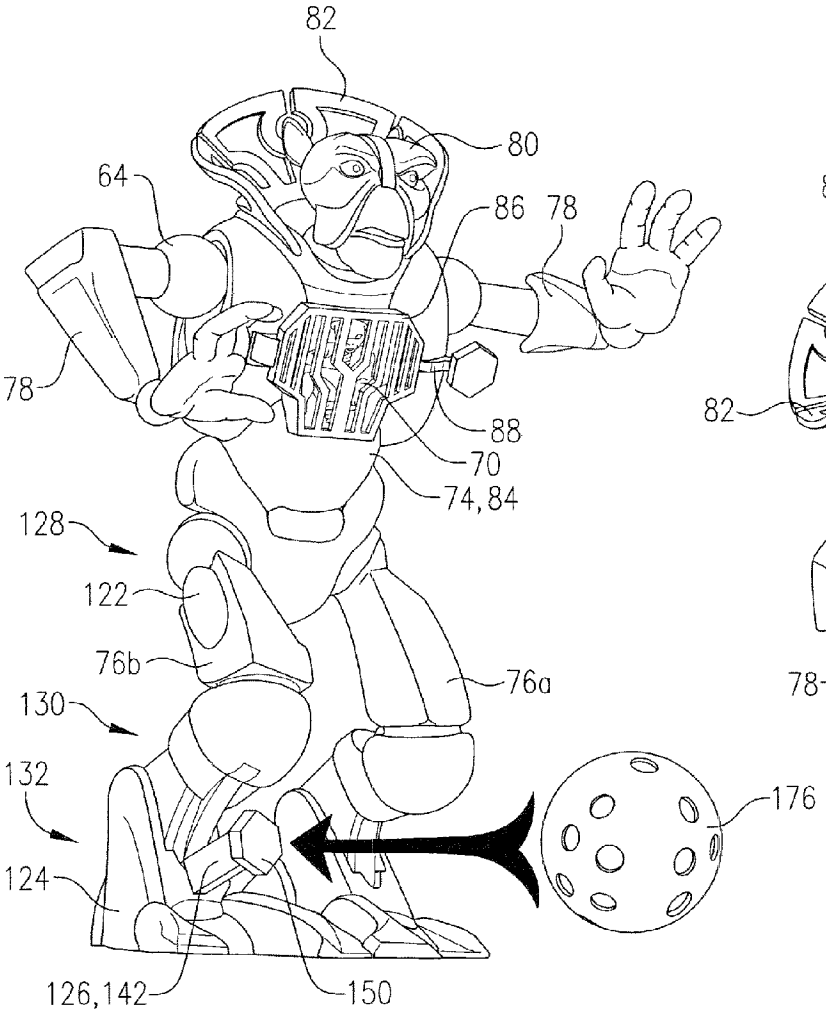
Figure 8B:
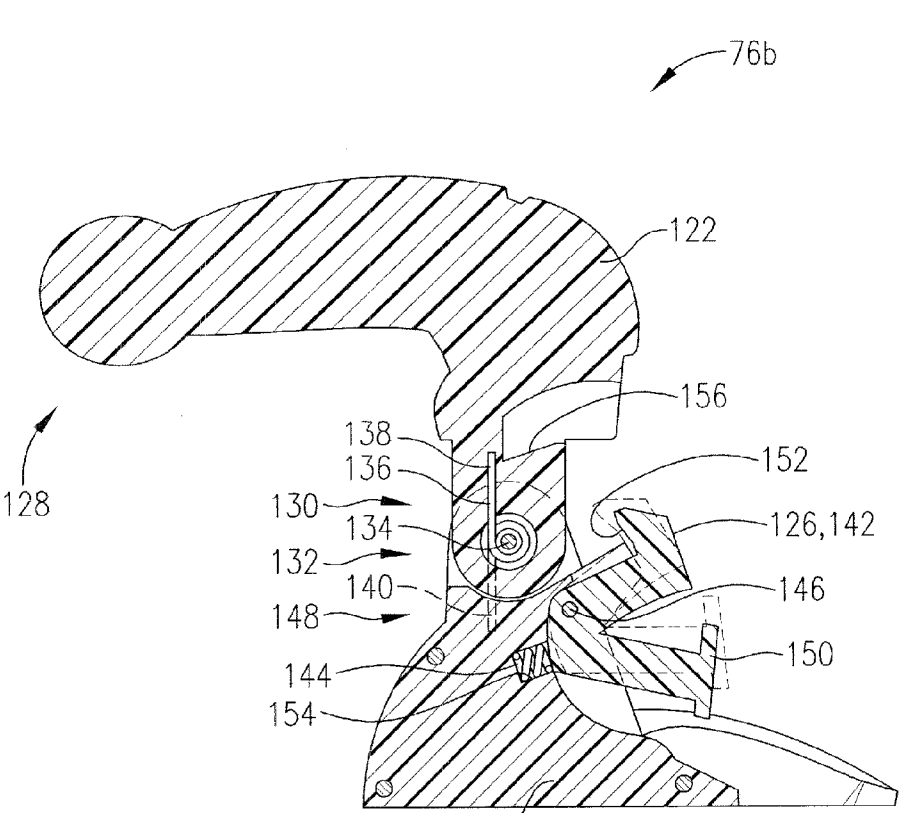
Figure 8A:
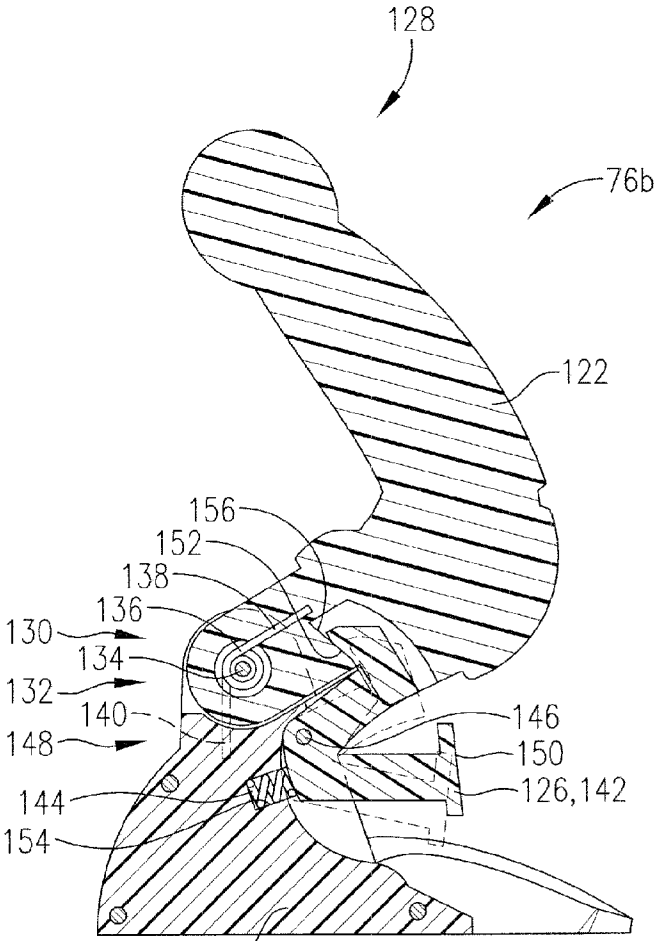
Figure 9A:
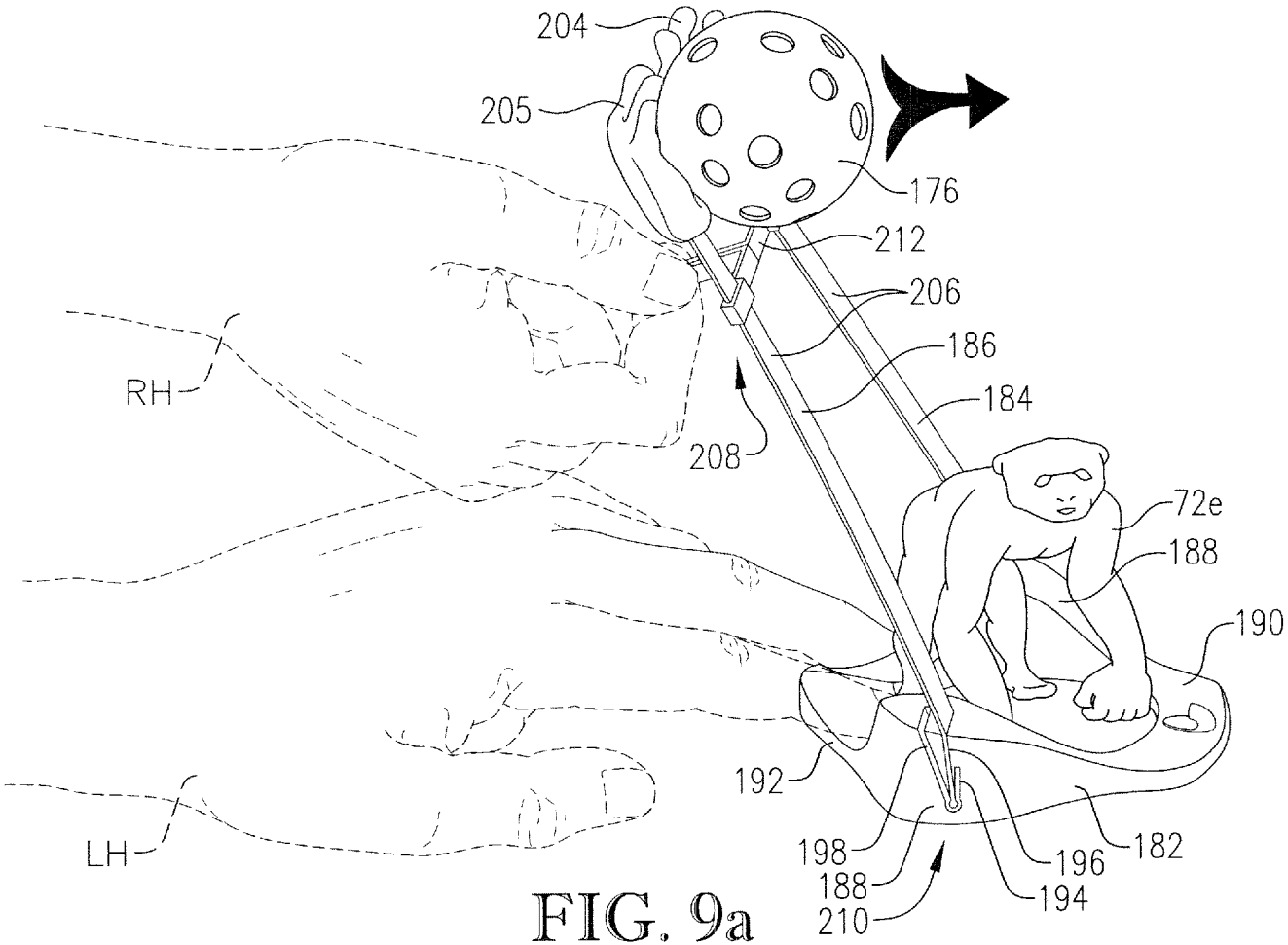
Figure 9B:
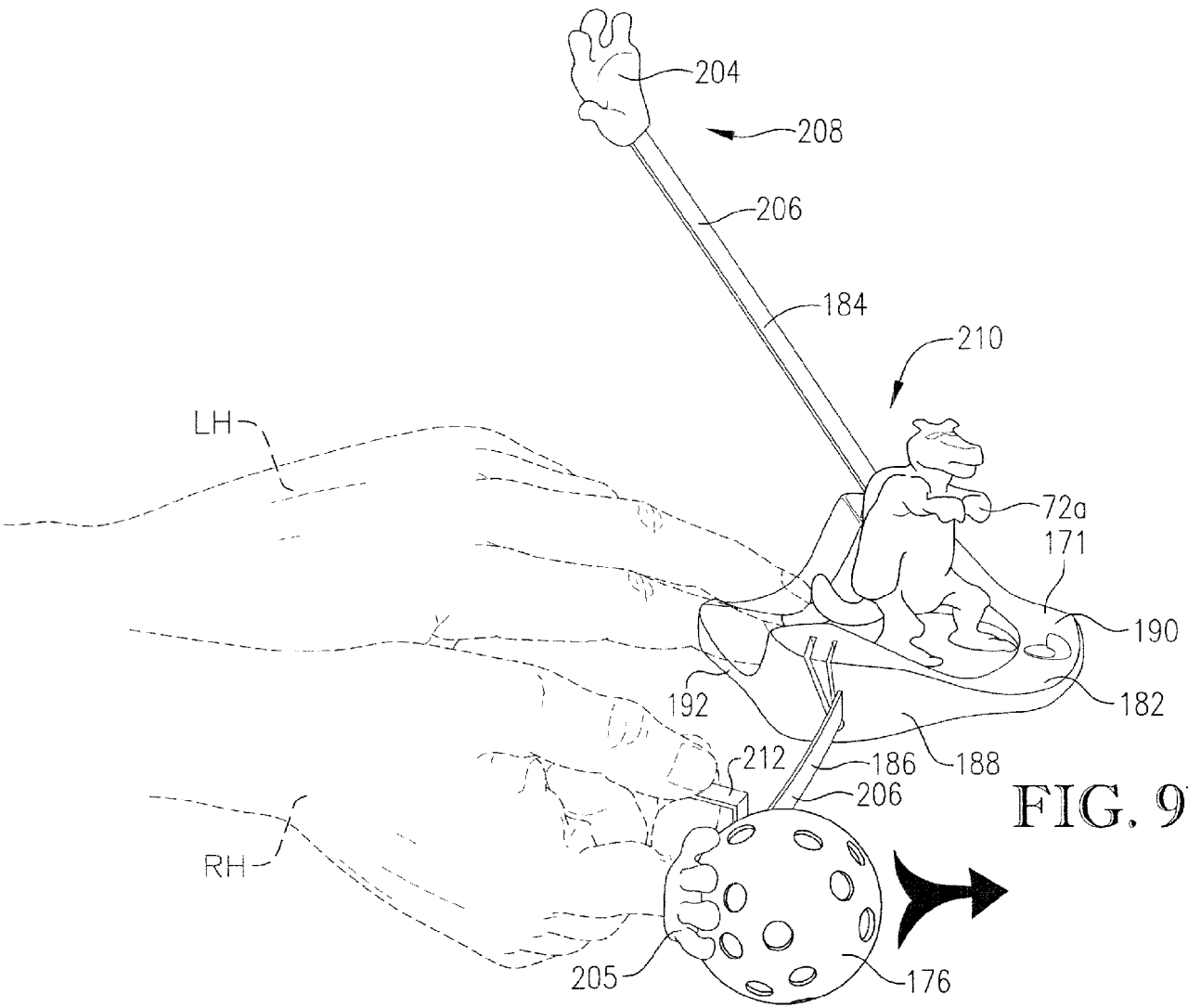
Figure 9C:
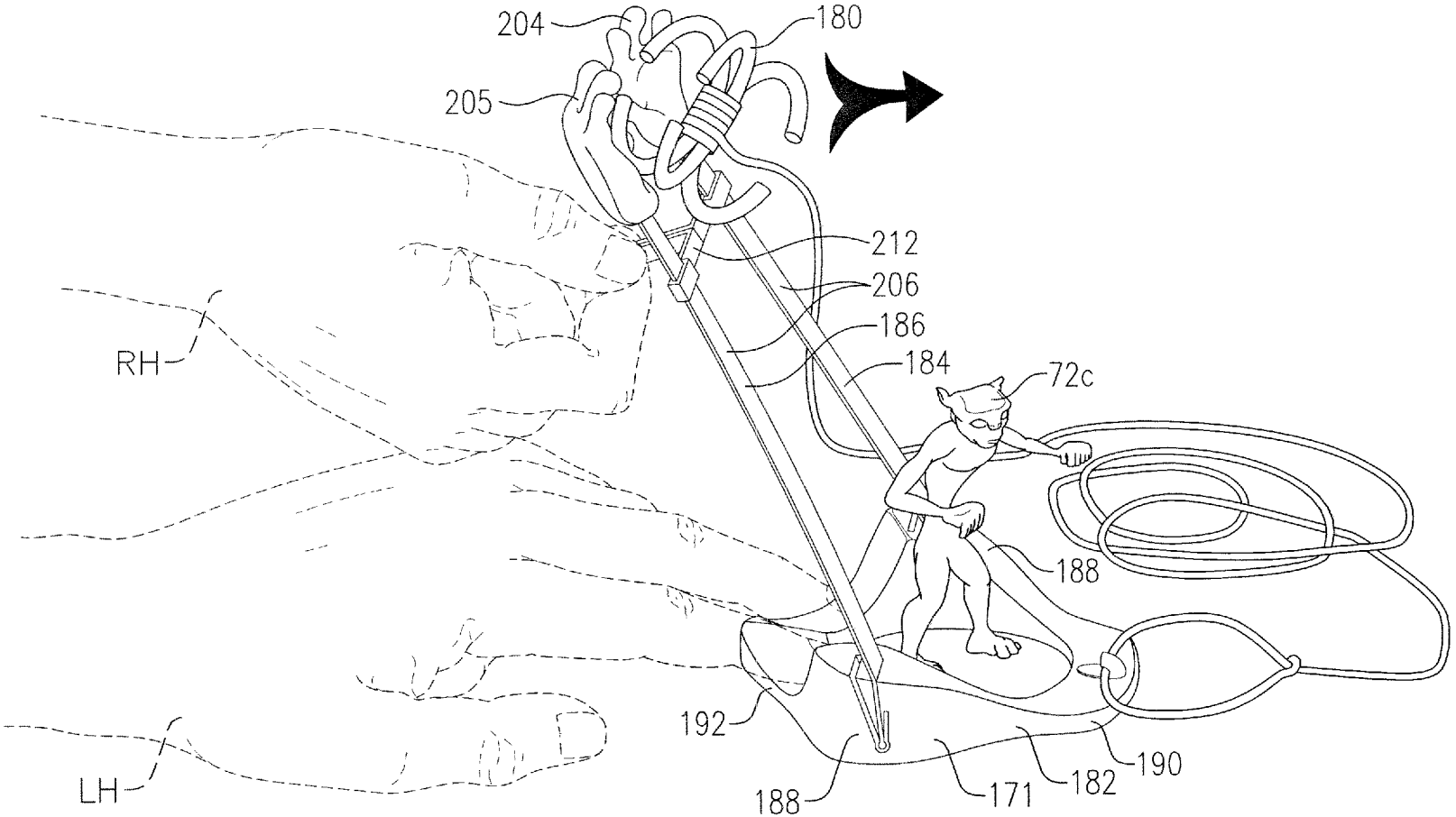
Figure 9D:
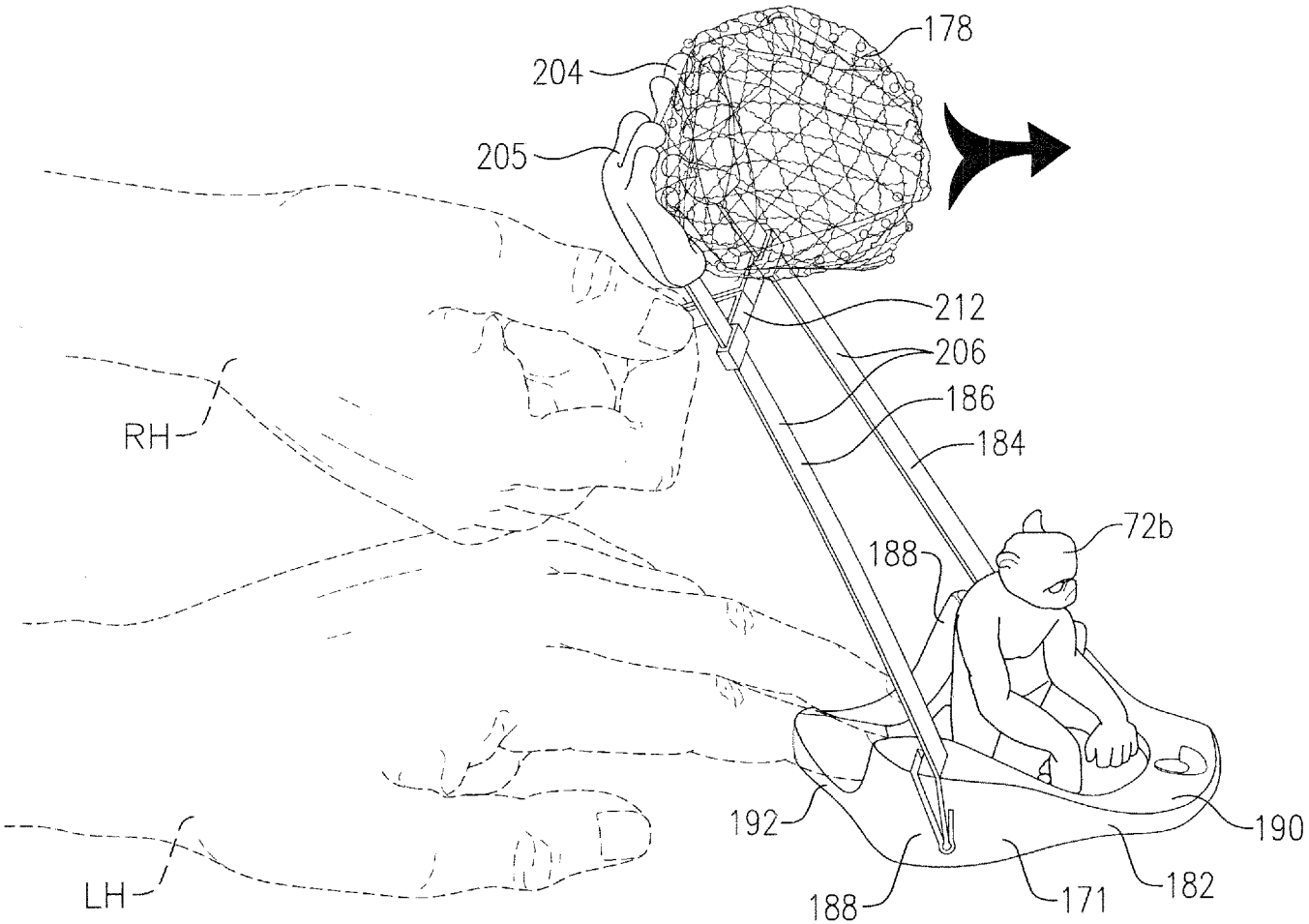
Figure 11:
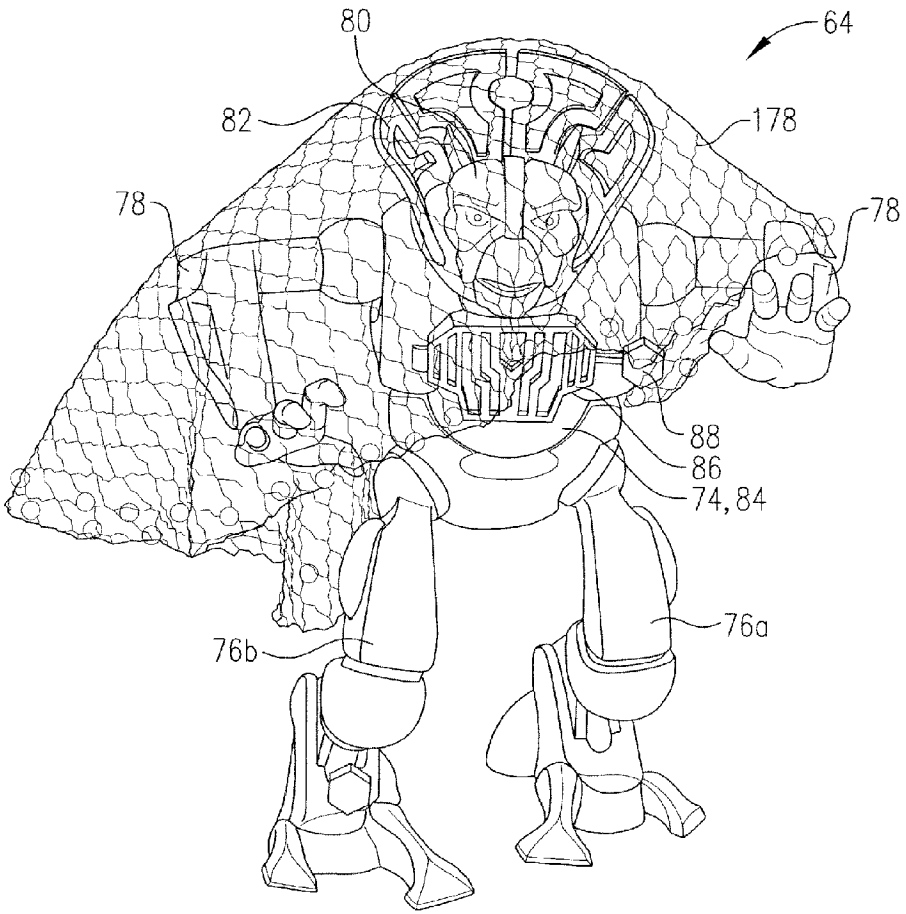
Figure 10:
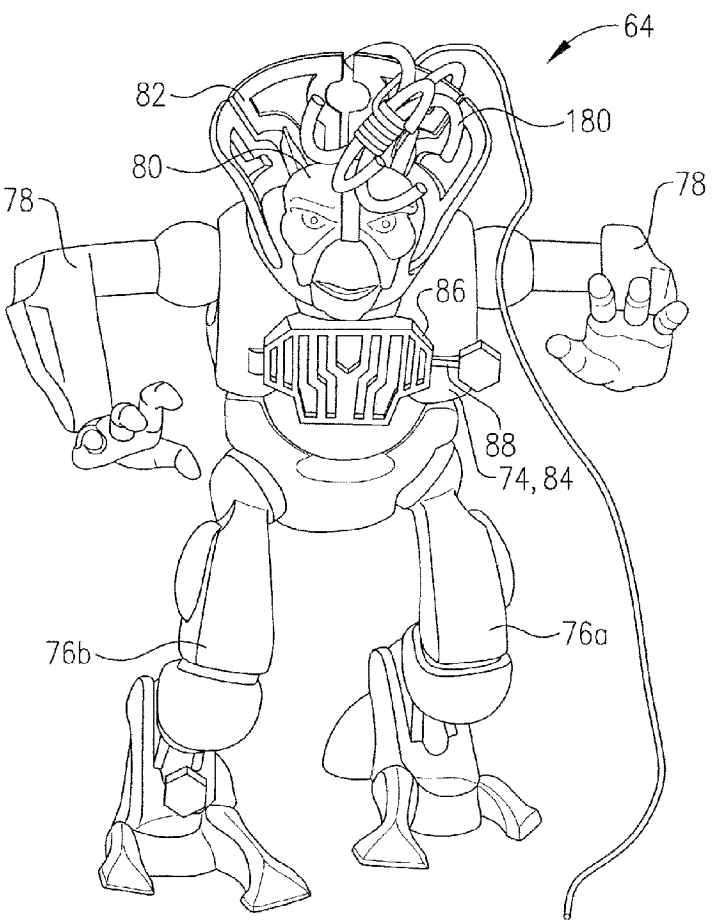
Figure 12:
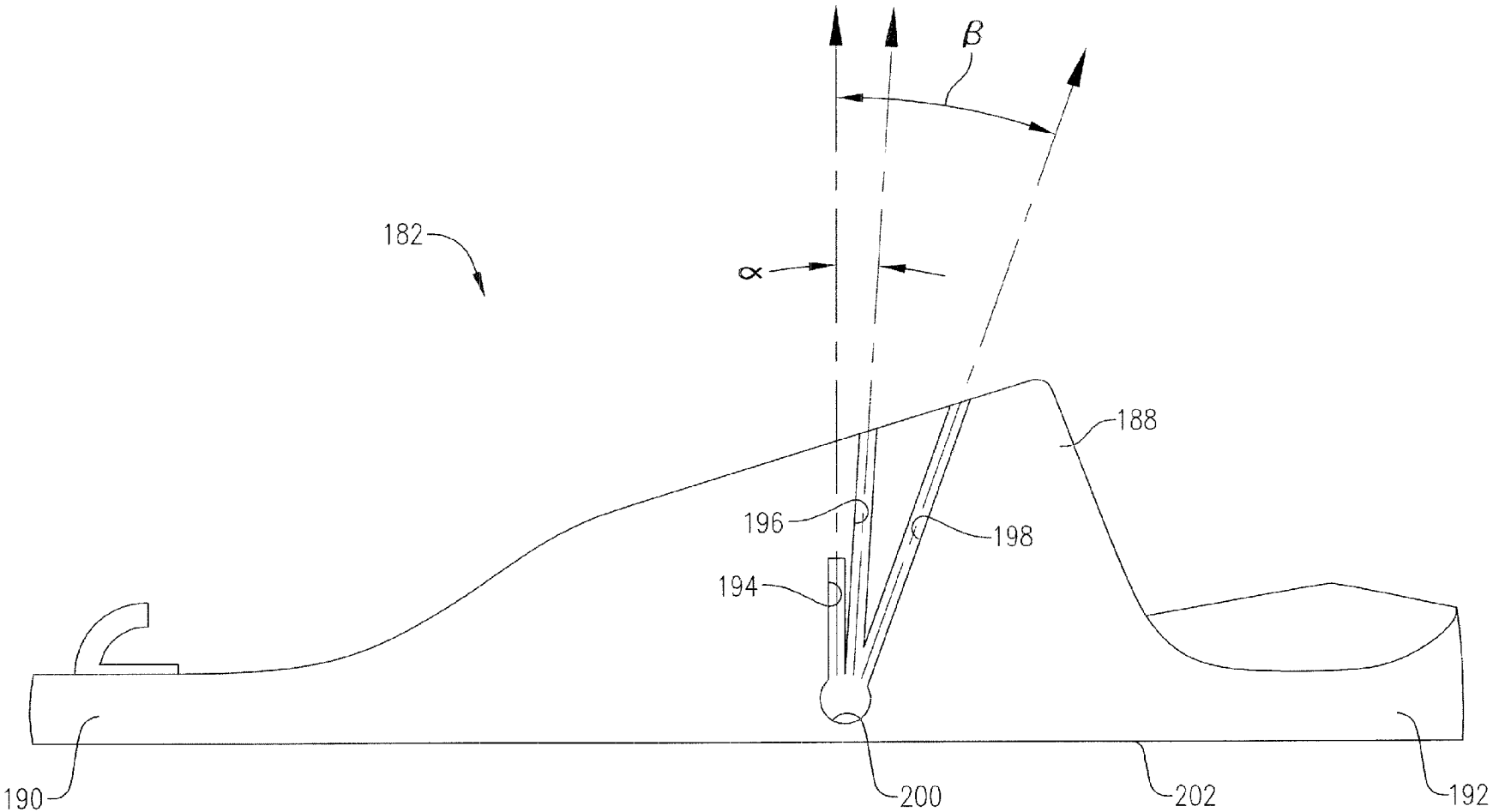
Figure 13:
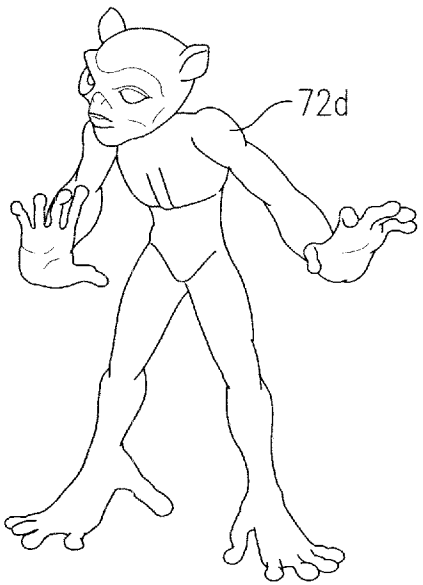
Figure 13:
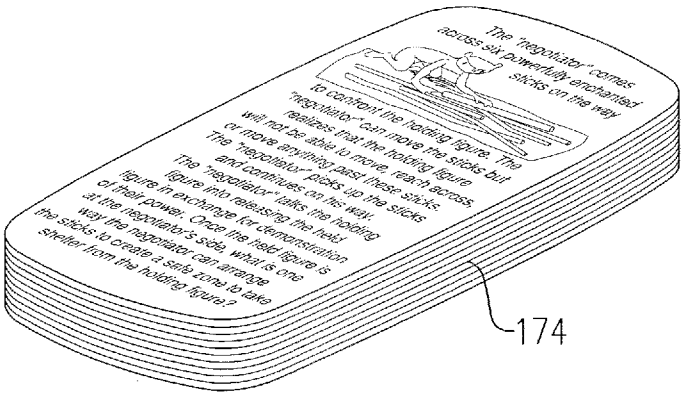
Figure 14A:
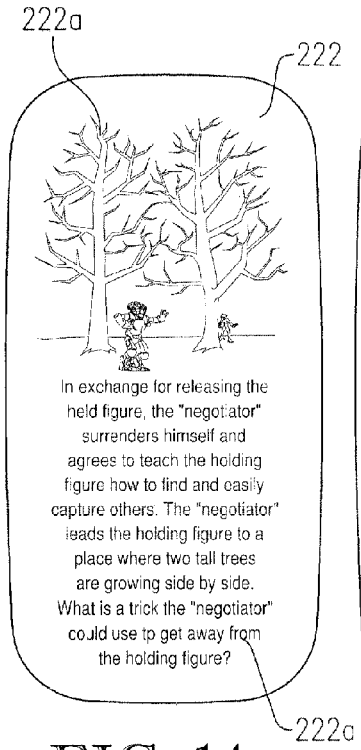
Figure 14B:
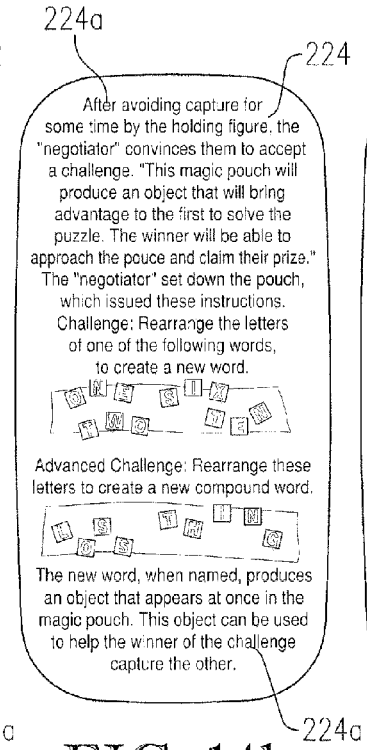
Figure 14C:
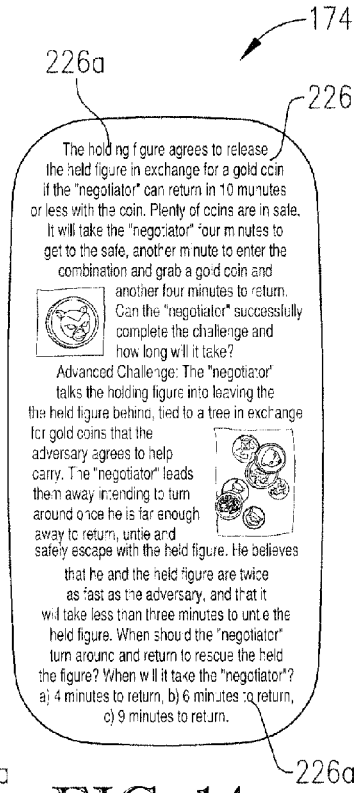
Figure 14D:
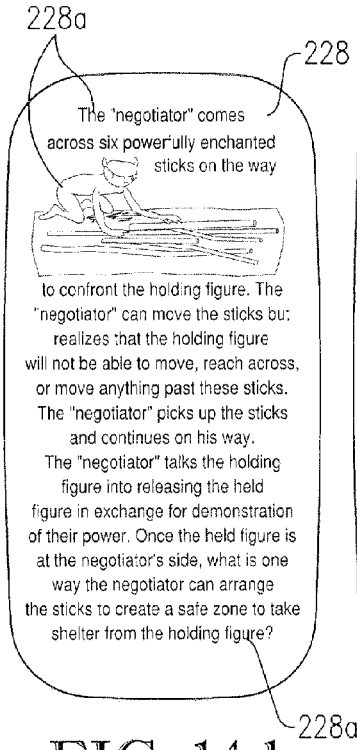
Figure 14E:
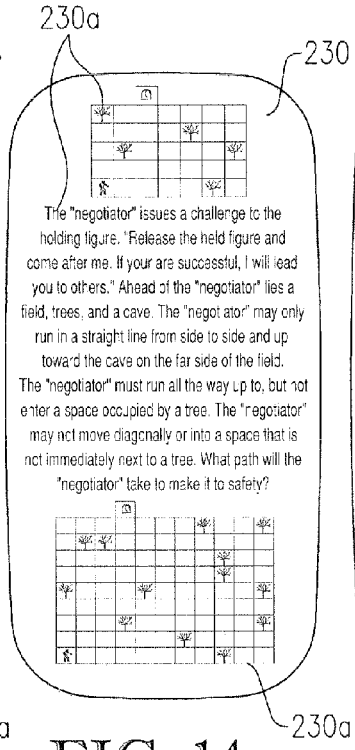
Figure 14F:
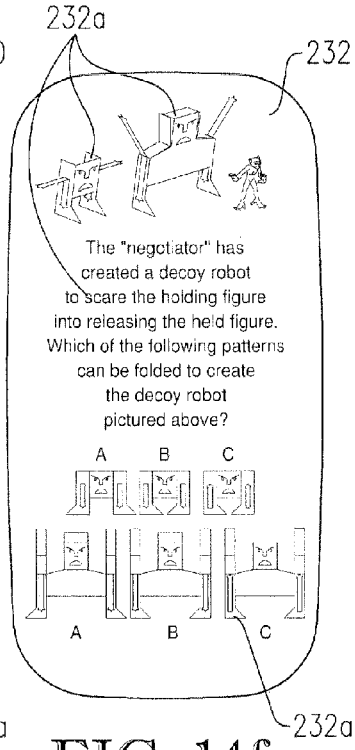
Figures 15A, 15B, 15C:
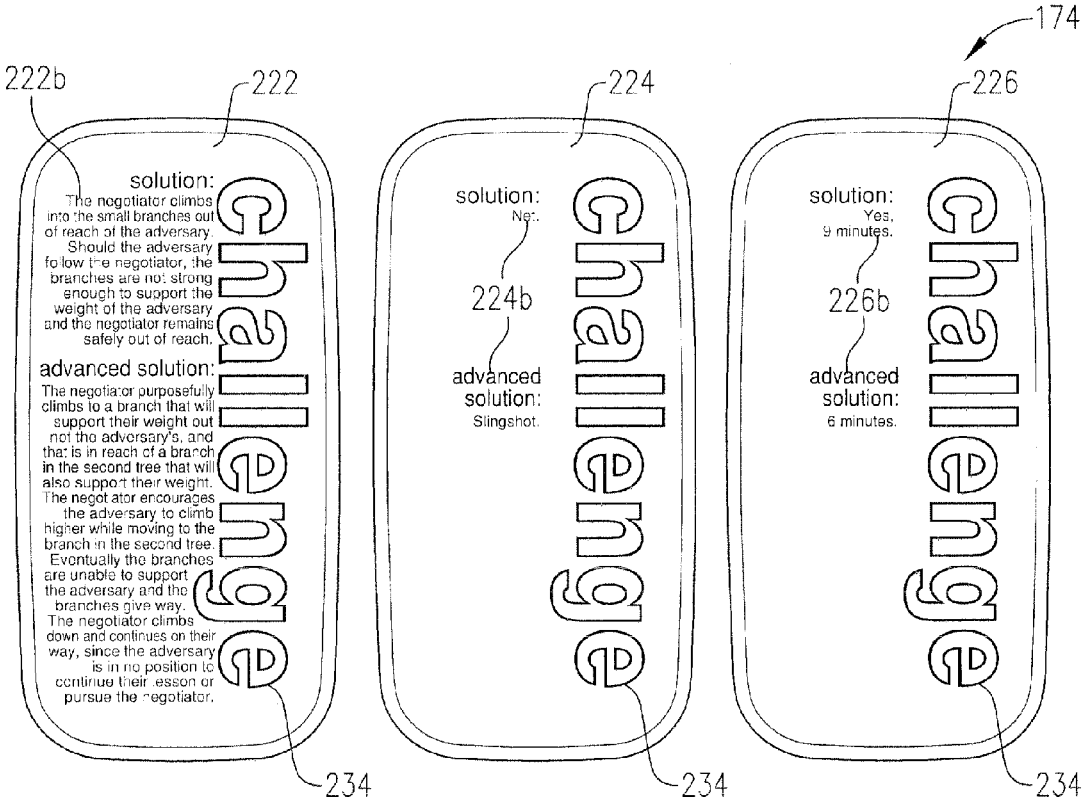
Figures 15D, 15E, 15F:
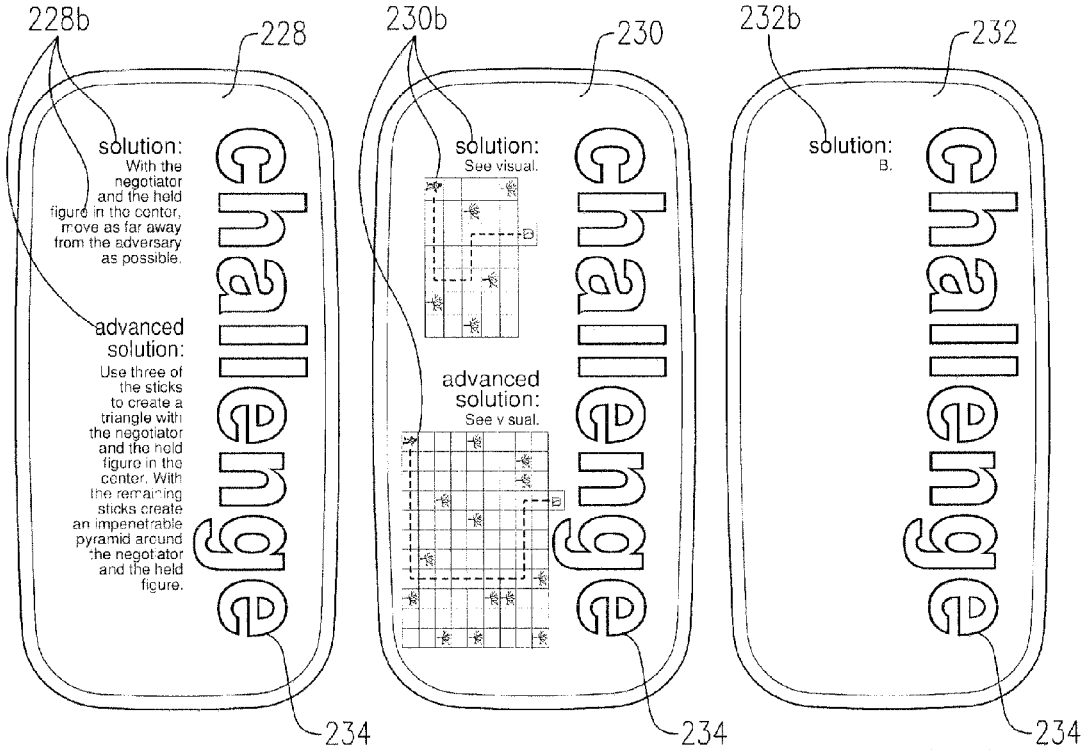
Figure 16B:
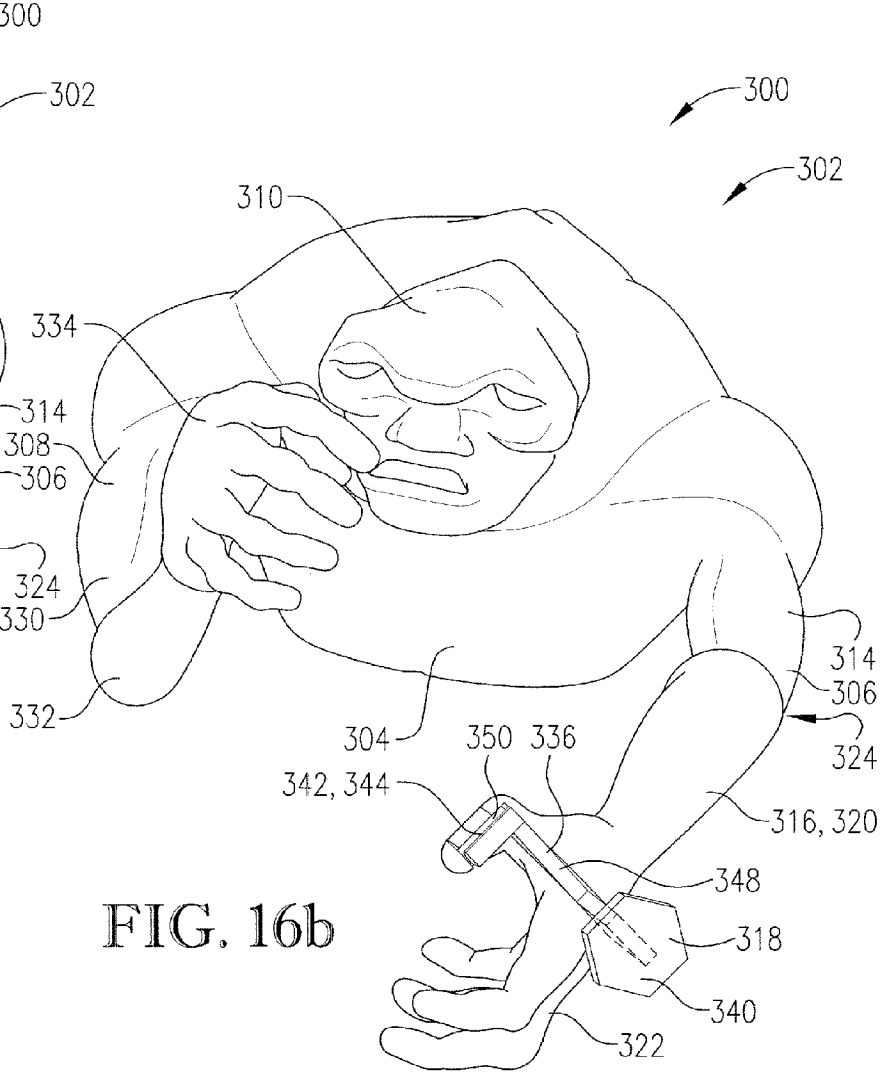
Figure 16A:
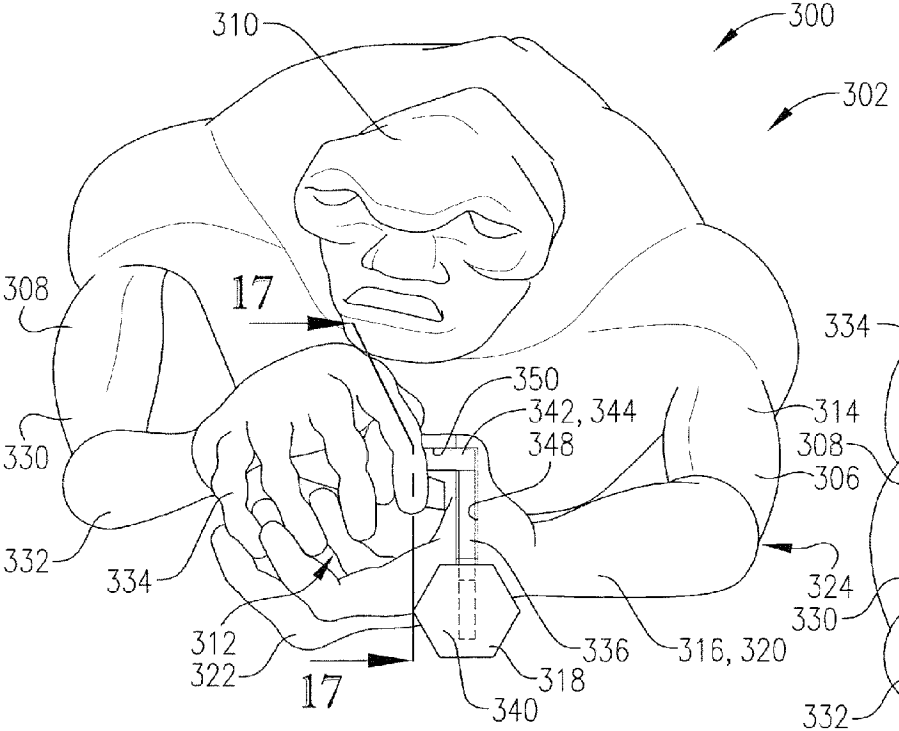
Figure 17A:
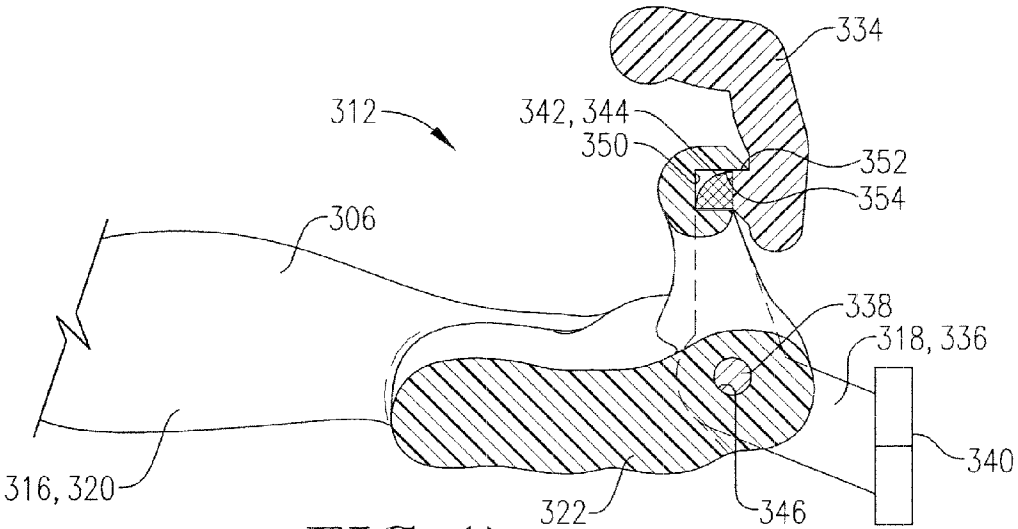
Figure 17B:
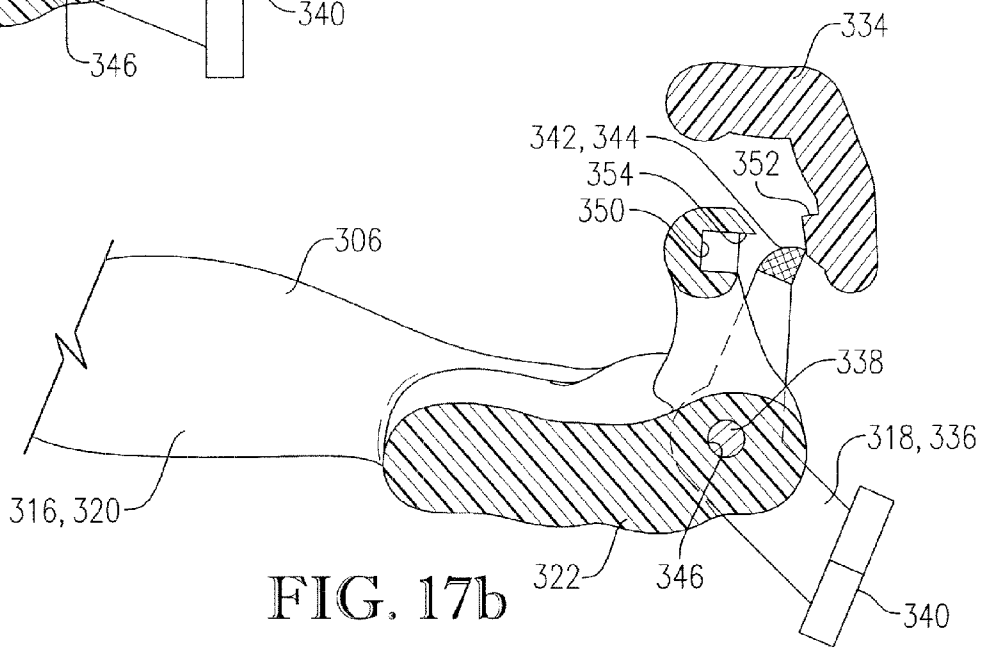
Figure 18B:
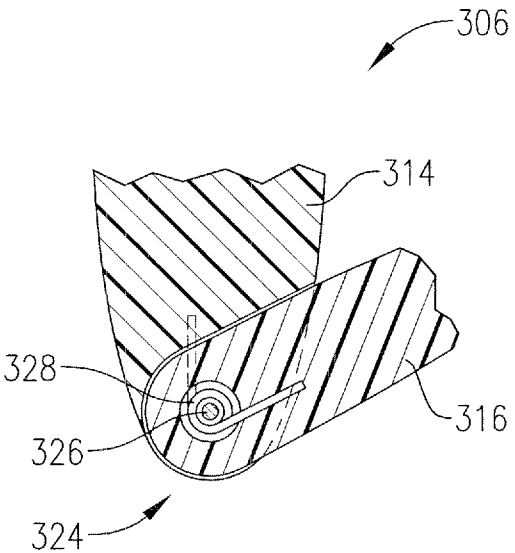
Figure 18A:
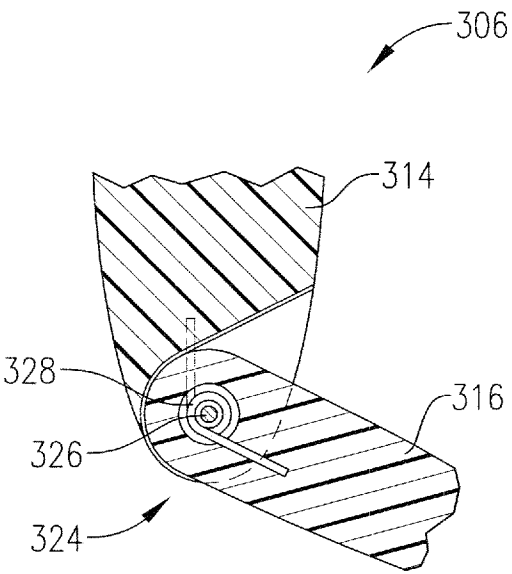

FIG. 4 is a top view of the game assembly shown in FIGS. 1-3, showing the game assembly arranged for game play, with the container positioned behind the holding figure to serve as a backdrop, and showing the movement indicator extended in a distal direction from adjacent the holding figure and positioned to one side of the game play area, further showing game spaces defined by the movement indicator;

FIG. 5*a* is an enlarged perspective of part of the holding figure, captured figure, and ball shown in FIGS. 1 and 2, with the holding figure having a torso, a shiftable door that covers an opening in the torso in a closed position to form a chamber, and a door latch mechanism to spring the door open, showing the captured figure positioned in the chamber, and showing the ball traveling in a direction toward a target of the latch mechanism;

FIG. 5*b* is an enlarged perspective similar to FIG. 5*a*, but showing the latch mechanism sprung open to release the door after the target has been struck by the ball, with the released door being pivoted into the open position;

FIG. 6*a* is a cross section of the holding figure as shown in FIG. 5*a*, but with the captured figure removed from the chamber, and showing the latch mechanism engaging the door and holding the door in the closed position;

FIG. 6*b* is a cross section similar to FIG. 6*a*, but showing the latch mechanism sprung open and the shiftable door pivoted into the open position;

FIG. 7*a* is a perspective of the holding figure, captured figure, and ball shown in FIGS. 1, 2, and 5*a*, with the holding figure in an upright position and including left and right legs, where the right leg has upper and lower leg sections that are pivotally connected, and a leg latch mechanism that permits the upper leg section to pivot when a target of the leg latch mechanism is struck by the ball, and showing the ball traveling in a direction toward the target of the leg latch mechanism;

FIG. 7*b* is a perspective similar to FIG. 7*a*, but showing the leg latch mechanism sprung open and thereby disengaged from the upper leg section after the target of the leg latch has been struck by the ball, with the released upper leg section being pivoted out of the upright position and the holding figure thereby being toppled;

FIG. 8*a* is a cross section of the holding figure as shown in FIG. 7*a*, showing the leg latch mechanism engaging the upper leg section and holding the upper leg section upright, with a latch of the leg latch mechanism also shown in hidden lines to depict a disengaged position;

FIG. 8*b* is a cross section similar to FIG. 8*a*, but showing the leg latch mechanism sprung open so that the latch is in the disengaged position, and showing the upper leg section pivoted out of the upright position;

FIG. 9*a* is a fragmentary perspective of the game assembly shown in FIGS. 2 and 3, showing two launcher arms and a base of the launcher, with the arms secured in an upright arm position in one set of angled base slots and the ball positioned in the arms for throwing, further showing a first one of the rescuing figures received by the base, and showing the base held by a left hand of a user and the arms drawn rearwardly by the right hand of the user;

FIG. 9*b* is a fragmentary perspective similar to FIG. 9*a*, but showing the right launcher arm secured in a lateral arm position in an upright base slot and the ball positioned in the right arm for rolling, further showing a second one of the rescuing figures received by the base;

FIG. 9*c* is a fragmentary perspective similar to FIG. 9*a*, but showing a third one of the rescuing figures received by the base, and showing the grapple positioned so that the grapple hook is located in the arms for throwing and a looped end of the grapple line is received by a hook presented by the launcher base;

FIG. 9*d* is a fragmentary perspective similar to FIG. 9*a*, but showing a fourth one of the rescuing figures received by the base, and showing the net rolled up and positioned in the arms for throwing;

FIG. 10 is a fragmentary perspective of the holding figure and grapple shown in FIGS. 1, 2, and 9*c*, showing the thrown grapple hook engaged with a collar of the holding figure and the grapple line extending downwardly from the grapple hook;

FIG. 11 is a perspective of the holding figure and net shown in FIGS. 1, 2, and 9*d*, showing the thrown net covering the head and eyes of the holding figure;

FIG. 12 is a side elevation of the launcher base shown in FIGS. 9*a-d*, showing a left side portion of the base presenting the upright base slot and a pair of angled base slots;

FIG. 13 is a perspective of the card set and a fifth one of the rescuing figures as shown in FIGS. 2 and 3;

FIGS. 14*a-f* are elevations of the front side of individual activity cards of the card set, showing question indicia;

FIGS. 15*a-f* are elevations of the back side of the individual activity cards shown in FIGS. 14*a-f*, showing label and solution indicia;

FIG. 16*a* is a fragmentary perspective of a game assembly constructed in accordance with a second embodiment of the present invention, showing an alternative holding figure that is operable to control a captured figure and release the captured figure when struck by an object, with the holding figure including a torso, head, right and left arms having pivotal right and left arm sections with hands, and a latch assembly, with the arm sections being closed to define a chamber to hold the captured figure;

FIG. 16*b* is a fragmentary perspective similar to FIG. 16*a*, but showing a latch of the latch assembly extended to disengage the arm sections so that the arm sections are pivoted out of the closed position;

FIG. 17*a* is a fragmentary cross section of the holding figure as shown in FIG. 16*a*, showing the arm sections in the closed position, with an index finger of the right hand engaging a thumb of the left hand, and a latch projection retracted in the left hand;

FIG. 17*b* is a fragmentary cross section similar to FIG. 17*a*, but showing the latch projection extended out of the hand so as to disengage the hands and permit the arm sections to pivot out of the closed position;

FIG. 18*a* is a fragmentary cross section of the left arm shown in FIG. 16*b*, showing upper and lower left arm sections connected at a pivotal joint by a pin and torsion spring, with the lower left arm section urged out of the closed position by the torsion spring; and FIG. 18*b* is a fragmentary cross section similar to FIG. 18*a*, but showing the lower left arm section in the closed position.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIGS. 1 and 2, a packaged game assembly 30 is used to play a game that challenges a player to free a gamepiece from control of an adversary. The illustrated game assembly 30 is configured for use as a one-player game. However, as will be discussed, it is also within the scope of the present invention where the game assembly 30 is configured for two-player use. The game assembly 30 broadly includes a container 32 and game components 34 for playing the adversarial game. As will be shown, the game components 34 comprise a physical embodiment of the game, i.e., the components have a physical structure. However, it is within the ambit of the present invention where the game components are either partly or entirely virtual. In other words, the principles of the present invention are applicable where the game is presented and played through the interface of a conventional computer and operates either on that computer or on another computer.

Game Assembly

The container 32 is preferably designed to package the components 34 for sale and for transportation thereof. Furthermore, the container 32 is preferably reusable for transporting the game between uses. As will also be described, the container 32 is preferably used as a backdrop while the game is played.

The container 32 preferably includes a base 36, top 38, front panel 40, rear doors 42, and removable insert 44. The base 36 and top 38 are generally opaque and each preferably comprise a unitary plate-like construction with a semicylindrical shape. The front panel 40 preferably comprises a thin rectangular piece of plastic that is generally transparent so that the components can be viewed when housed in the container. The front panel 40 has opposite upper and lower ends that are respectively attached to the top 38 and base 36. A pair of elongated upright members 46 are preferably attached to respective side edges of the front panel 40 and to respective ends of the base 36 and top 38. The base 36, top 38, front panel 40, and members 46 cooperatively present an opening 48 and form a generally rigid housing for holding the components 34. The rear doors 42 are each preferably rectangular in shape. The doors 42 are preferably attached to corresponding members 46 via a living hinge 50. The doors 42 each pivot from a closed position (see FIG. 1) where the door 42 covers the opening 48 to an open position where the opening 48 is exposed (see FIG. 2).

The insert 44 is opaque and preferably includes a generally semicylindrical tray section 52, a rear panel section 54, and a generally semicylindrical upper figure section 56. The sections 52,54,56 are preferably integrally formed with one another, with the figure section 56 being spaced above the tray section 52. The tray section 52 presents an upper surface with various openings 58*a-e* that are formed to receive corresponding playing accessories. Similarly, the figure section 56 presents a front surface with openings 60*a-f* that are formed to receive playing figures. The insert 44 also presents a rear slot 62 that receives a measurement indicator of the components 34 (see FIG. 2).

The insert 44 is preferably slidable into and out of the opening 48, i.e., by sliding along a fore-and-aft direction. Thus, to remove the components 34 from the container 32, the doors 42 are opened and the insert 44 is preferably slid rearwardly out of the opening 48. Once the components 34 are removed, the insert 44 can be returned by sliding the insert 44 forwardly into the opening 48. In this configuration, the container 32 can be used as a backdrop for the game, as will be discussed. The container 32 is preferably made from a synthetic resin material, but could include other materials.

Turning to FIGS. 2-4, the game components 34 are used to play an adversarial game and preferably include a holding figure 64, squad members 66, and extendable movement indicator 68. The squad members 66 include a captured figure 70 and rescuing figures 72*a-e*, which are preferably in the form of various animate creatures. As will be discussed in greater detail, the object of the game is to free the captured figure 70 from the holding figure 64. The game has been found to challenge both mental skill and manual dexterity of a player. The game is initiated with the holding figure 64 controlling the captured figure 70. One or more of the rescuing figures 72*a-e* can be pitted against the holding figure 64 to secure the release of the captured figure 70. Each figure 72*a-e* is associated with a skill that can be used to act against the holding figure 64 to release the captured figure 70, as will be described further. The figures 72*a-e* can be moved along game spaces defined by the movement indicator 68 and can thereby be positioned to act against the holding figure 64.

Turning to FIGS. 5*a*-8*b*, the holding figure 64 is used in game play to control the captured figure 70. The holding figure 64 also can retaliate against figures 70,72 within the game spaces. The holding figure 64 is preferably in the form of an animate robot, but for some aspects of the present invention, the holding figure 64 could take another form, such as an animate creature (e.g., a dinosaur or troll) or an inanimate game piece. The illustrated holding figure 64 broadly includes a torso assembly 74, legs 76*a,b*, arms 78, head 80, and collar 82. The arms 78, head 80, and collar 82 are preferably made of a synthetic resin material, but could include other materials without departing from the scope of the present invention.

Turning to FIGS. 5*a*-6*b*, the illustrated torso assembly 74 is preferably configured to contain the captured figure 70, particularly during game play. The torso assembly 74 preferably includes a torso 84, a door 86, and a door latch assembly 88. The illustrated torso 84 is preferably unitary and presents an opening 90 that is sized to receive the captured figure 70 (see FIG. 5*b*). The door 86 is unitary and includes a hinged end 92 and a catch end 94. The hinged end 92 is pivotally mounted adjacent one side of the opening 90, with the door 86 being pivotal between an open door condition and a closed door condition. A metal pin 96 pivotally secures the hinged end 92 to the torso 84. A metal torsion spring 98 has corresponding ends 100,102 that are attached, respectively, to the torso 84 and door 86 so that the spring 98 urges the door 86 from the closed door condition to the open door condition (see FIGS. 6*a* and 6*b*).

The door latch assembly 88 provides a mechanism to open the door 86 when the mechanism is struck by an object. The door latch assembly 88 includes a latch 104, a spring 106, and a metal pin 108 (see FIGS. 6*a* and 6*b*). The latch 104 includes a hinged end 110, a target end 112, and a shoulder 114. The latch 104 is pivotally mounted to the torso 84 using the pin 108 and is positioned along an edge of the opening 90. Thus, the latch 104 can preferably be pivoted between a latching position (see FIGS. 5*a* and 6*a*) and an open position (see FIGS. 5*b* and 6*b*). The spring 106 comprises a metal coil spring and is received in a hole 116. The spring 106 urges the latch 104 into the latching position. The illustrated target end 112 provides a target that, when struck by an object and shifted by the object into an actuated position, causes the latch 104 to shift from the latching position to the open position (see FIGS. 5*b* and 6*b*). The latch 104, door 86, and torso 84 of the torso assembly 74 are all preferably made of a synthetic resin material, but could include other materials.

The door latch assembly 88 is generally configured to hold the door 86 closed if the target is not struck by an object. However, the latch assembly 88 may permit the door 86 to open in some instances where the target is not struck by the object (e.g., where the holding figure 64 is toppled). In particular, the shoulder 114 engages a shoulder 118 presented by the door 86 and thereby restricts opening movement of the door 86. When an object, such as a ball, is thrown toward and strikes the target, the force of the object urges the latch 104 to move against the spring 106 until the shoulder 114 becomes disengaged from shoulder 118. When the shoulders 114,118 are disengaged, the spring 98 urges the door 86 open.

While the illustrated door latch assembly 88 is preferably used to yieldably hold the door 86 in the closed door position, it is also within the ambit of the present invention where a different type of latch device is used. For instance, the holding figure 64 could have an electromechanical latch. The illustrated latch assembly 88 is preferably constructed so that the target (i.e., the target end 112) is integral with the latch 104. However, the latch assembly 88 could be configured with an alternative target mechanism that is actuated by an object and thereby releases the latch assembly from the latching position. For instance, the latch assembly 88 could have an electronic sensor (e.g., a light sensor or a proximity sensor) that is operably coupled to a latch and causes the latch to shift out of the latching position.

The torso 84 and door 86 cooperatively provide a chamber 120. When in the closed door condition, the torso 84 and door 86 cooperatively restrict ingress and egress of the captured figure 70 relative to the chamber 120. In the open door condition, the torso 84 and door 86 permit figure ingress and egress relative to the chamber 120.

The illustrated holding figure 64 is preferably configured so that the chamber 120 removably receives the captured figure 70. However, it is also within the ambit of the present invention where the holding figure 64 is alternatively configured to contain the holding figure 64, as will be shown in a subsequent embodiment. Furthermore, the game assembly 30 could be configured so that a structure, such as a cage, associated with the holding figure 64 is used to control the captured figure 70.

Turning to FIGS. 7*a*-8*b*, the legs 76*a,b* support the rest of the holding figure 64 in the usual manner. The illustrated leg 76*a* comprises a generally unitary and rigid construction having a leg section and a foot attached to the lower end of the leg section. The leg 76*a* is attached to the torso 84 at an upper end of the leg section.

Preferably, the leg 76*b* is shaped similarly to the leg 76*a* but is yieldable so that the holding figure 64 can be toppled by a rolled object that strikes the leg 76*b*. The leg 76*b* includes a leg section 122, a foot 124, and a leg latch assembly 126. The leg section 122 is elongated and includes an upper end 128 and a lower hinged end 130. The foot 124 includes a hinged end 132, with the hinged ends 130,132 being pivotally interconnected by a pin 134 (see FIGS. 8*a* and 8*b*). The leg section 122 and foot 124 are pivotal into and out of a figure supporting position (see FIG. 8*a*). The leg 76*b* also includes a torsion spring 136 with spring ends 138,140 that are attached respectively to the leg section 122 and foot 124. The spring 136 urges the leg section 122 and foot 124 into the figure supporting position.

The leg latch assembly 126 comprises a device that allows the leg section 122 and foot 124 to pivot out of the figure supporting position when the device is struck by an object. The leg latch assembly 126 includes a latch 142, a spring 144, and a metal pin 146. The latch 142 includes a hinged end 148, a target end 150, and a shoulder 152 (see FIGS. 8*a* and 8*b*). The latch 142 is pivotally mounted to the foot 124 and is positioned adjacent the hinged end 132 of the foot 124. The latch 142 is pivotally mounted using the pin 146 within a groove of the foot 124, with the latch 142 projecting out of the groove to the target end 150 located forwardly of the foot 124. The latch 142 can preferably be pivoted between open and latching conditions. The illustrated target end 150 provides a target that, when struck by an object and shifted by the object into an actuated position, causes the latch 142 to shift from the latching position to the open position (see FIGS. 7*b* and 8*b*). The spring 144 is preferably a metal coil spring that is received in a hole 154 presented by the foot 124. The spring 144 urges the latch 142 into the latching condition. The leg section and foot of the legs 76*a,b* are all preferably made of a synthetic resin material, but could include other materials.

The leg latch assembly 126 is generally configured to hold the leg 76*b* in the figure supporting position if the target end 150 is not struck by an object. However, the leg latch assembly 126 could allow the leg sections to pivot in some circumstances when the target is not struck (e.g., when the holding figure 64 is toppled). Specifically, the shoulder 152 engages a shoulder 156 presented by the leg section 122 adjacent the lower hinged end 130 so that the shoulders 152,156 cooperatively restrict pivotal movement between the leg section 122 and foot 124. When an object, such as a ball, is thrown toward and strikes the target end 150, the force of the object urges the latch 142 to move against the spring 144 until the shoulders 152,156 become disengaged from one another. When the shoulders 152,156 are disengaged, the spring 144 urges the leg 76*b* out of the figure supporting position.

The illustrated leg latch assembly 126 is preferably used to yieldably hold the leg 76*b* in the figure supporting condition. However, similar to the door latch assembly 88, it is also within the ambit of the present invention where a different type of latch device is used. For example, the leg 76*b* could have an electromechanical latch. The illustrated latch assembly 126 is preferably constructed so that the target (i.e., the target end 150) is integral with the latch 142. However, the latch assembly 126 could also be configured with an alternative target mechanism that is actuated by an object and thereby releases the latch assembly from the latching position. For instance, the latch assembly 126 could have an electronic sensor (e.g., a light sensor or a proximity sensor) that is operably coupled to a latch and causes the latch to shift out of the latching position. For some aspects of the present invention, the holding figure 64 could have an alternative construction that permits the holding figure 64 to be disabled during game play. For instance, the holding figure 64 could include a device incorporated into leg 76*a* that causes the holding figure 64 to be toppled by a rolled object that strikes the leg 76*a*.

Turning to FIGS. 2 and 4, the movement indicator 68 preferably includes multiple sections 158 that are pivotally connected in series with one another. Each section 158 is preferably a unitary plate and presents opposite plate ends 160. The sections 158 are preferably made of a synthetic resin material, but could include other materials. Adjacent sections 158 are pivotally secured to one another by a fastener 162, such as a rivet, that extends through overlapped ends 160 of the adjacent sections. Thus, the indicator 68 is preferably constructed to be shiftable between a collapsed condition and an extended condition where the indicator 68 extends between proximal and distal ends 164,166 thereof. The indicator provides indicia (i.e., pointed edge features) associated with the location of game spaces 168*a-k* that are arranged along a generally straight path from a proximal location to a distal location. In particular, the pointed edge features delineate the line between adjacent game spaces (the adjacent game spaces 168 are further delineated by phantom lines) (see FIG. 4). The illustrated construction preferably provides eleven game spaces 168, but an alternative number of spaces could be used. Furthermore, the spaces 168 could be positioned to extend along a curved path. It is also within the scope of the present invention where an alternative structure, e.g., a game board, defines game spaces and is operable to receive various components 34 during game play.

In setting up the game, the holding figure 64 is located adjacent to the proximal end 164 of the indicator 68 and positioned in proximal game space 168*a*, with the container 32 being located behind the holding figure 64 to provide a backdrop for the game. Initially, the captured figure 70 is positioned in the chamber 120 and the rescuing figure 72 are spaced from the game spaces 168. As will be shown, figures 70,72 can move into and out of the game spaces 168 during game play.

Preferably, the rescuing figure 72 are used to free the captured figure 70 in a one-player game. However, it is also within the scope of the present invention, where the game assembly 30 is configured for a two-player game. As will be discussed, the game assembly 30 could have a holding figure 64 and squad members 66 for each of two players.

The game components 34 further include projectiles 170, projectile launcher 171, dice 172, and activity card set 174. While not shown herein, the game could include other components for game play, such as a timer. The projectiles 170 are used by corresponding rescuing figure 72 against the holding figure 64. The projectiles 170 preferably are configured to be thrown by the launcher 171 at the holding figure 64 and include a ball 176, a net 178, and a grapple 180. The ball 176 preferably comprises a spherical plastic shell with multiple holes. The net 178 preferably includes a mesh layer with round weights attached around the perimeter of the layer. The grapple 180 preferably includes a grapple hook with multiple hook ends that project from a central body of the hook and a line tied to the hook at one end and having an opposite looped end. The grapple hook is preferably made from synthetic resin but could include other materials.

As will be discussed, the ball 176 is operable to be thrown so as to strike the target end 112 and thereby open the door 86. Similarly, the ball 176 can be rolled to strike the target end 150 and thereby topple the holding figure 64. The net 178 is configured to be thrown over the head 80 of the holding figure 64. The grapple 180 is configured to be thrown so that the grapple 180 becomes hooked onto the collar 82 of the holding figure 64. However, it is also within the scope of the present invention where other types of projectiles (such as a spear) can be used to act against the holding figure 64.

Turning to FIGS. 4 and 9*a*-9*d*, the launcher 171 can be used by a player to throw one of the projectiles 170 at the holding figure 64. The launcher 171 preferably includes a base 182 and left and right arms 184,186 adjustably mounted to the base 182. The base 182 is preferably unitary and includes side portions 188, a forward rim 190, and a rear grip 192. Preferably, the forward rim 190 presents a relatively small height dimension and includes an upwardly projecting hook. The rear grip 192 presents a top surface that includes a pair of side-by-side scallops that are shaped to receive fingers of a player's hand (see FIGS. 9*a*-9*d*).

Turning to FIG. 12, the side portions 188 present a height dimension that is generally greater that the rim 190 and grip 192. The side portions 188 each include slots 194,196,198 that project from a lateral hole 200. Slots 194 are substantially vertical relative to a flat bottom surface 202 of the base 182. Slots 196 are angled rearwardly from the axis of slot 194 at an angle α that preferably ranges from about five (5) degrees to about twenty (20) degrees and, more preferably, ranges from about five (5) degrees to about ten (10) degrees. Slots 198 are angled rearwardly from the axis of slot 194 at an angle β that preferably ranges from about ten (10) degrees to about sixty (60) degrees and, more preferably, ranges from about thirty (30) degrees to about fifty (5) degrees. The base 182 is preferably made from a synthetic resin material, but could include other materials.

Turning again to FIGS. 9*a*-9*d*, the arms 184,186 preferably include projectile holders 204,205 and an elongated spring 206. The holders 204,205 are preferably unitary and generally formed in the shape of left and right hands, although the holders 204,205 could have a different shape (e.g., to present a generally concave surface to cradle the projectiles). The holders 204,205 are preferably formed of a synthetic resin material, but could include other materials. The spring 206 preferably comprises a unitary metal strip formed of spring steel and presents opposite ends 208,210 (see FIGS. 9*a* and 9*b*). End 208 of the spring 206 is attached to the holder 204,205. The other end 210 of the spring 206 is removably attached to the corresponding side portion 188.

The arms 184,186 are configured so that the ends 210 can each be selectively inserted into one of the slots 194,196,198. In a first throwing configuration, the arms 184,186 are arranged uprightly, with the ends 210 inserted into slots 196 and the arms 184,186 secured to each other with a connector 212. The connector 212 includes two connector members that are preferably removably interlocked and made of synthetic resin, such as a clear plastic. The connector members serve as a grip for the arms 184,186 and can be used at the same time (e.g., see FIG. 9*a*) or individually (see FIG. 9*b*). The first throwing configuration produces a relatively flat throwing trajectory.

In a second throwing configuration, the arms 184,186 are arranged uprightly and secured with the connector 212, with the ends 210 inserted into slots 198. Compared to the first throwing configuration, the second throwing configuration produces a relatively lofted throwing trajectory.

Turning to FIGS. 9*a*-9*d*, in either the first or second throwing configurations, the launcher 171 can be used to throw the ball 176, net 178, or grapple 180. For instance, the ball 176 can be thrown by cradling the ball 176 in holders 204. At the same time, a player grasps the base 182, e.g., with the player's left hand LH, to stabilize the launcher 171. The player also grasps the connector 212, e.g., with the player's right hand RH. However, the launcher 171 is configured so that a player could grasp the base 182 with the right hand and grasp the connector 212 with the left hand. The player can draw the connector 212, the holders 204,205, and ball 176 rearwardly to tension the arms 184,186. Once the arms 184,186 are sufficiently tensioned, the player can release the connector 212 and allow the ball 176 to be thrown by the launcher 171, while maintaining a grasp of the launcher base 182.

Similarly, a grapple hook of grapple 180 can be positioned in holders 204, with a string of the grapple 180 extending from the hook to a loop that is secured to the hook of the base 182. The grapple 180 can be thrown by grasping the base 182, e.g., with the player's left hand LH (see FIG. 9*c*). The player also grasps the connector 212, e.g., with the player's right hand RH. Again, the player can draw the connector 212, the holders 204,205, and grapple hook rearwardly to tension the arms 184,186, and can then release the connector 212 to throw the grapple hook.

Net 178 can be loosely folded and cradled in holders 204, 205. The net 178 can be thrown by grasping the base 182, e.g., with the player's left hand LH (see FIG. 9*d*). The player also grasps the connector 212, e.g., with the player's right hand RH. The player can draw the connector 212, the holders 204,205, and net 178 rearwardly to tension the arms 184,186, and can then release the connector 212 to throw the net 178.

In a rolling configuration, at least one of the arms 184,186 is arranged laterally with the end 210 inserted to the respective slot 194 so that the arm extends along the playing surface (see FIG. 9*b*). The rolling configuration permits the launcher 171 to roll the ball 176 along the playing surface. The ball 176 can be rolled by grasping the base 182, e.g., with the player's left hand LH (see FIG. 9*b*). The player also grasps the connector section, e.g., with the player's right hand RH. The player can draw the connector 212, the holders 205, and ball 176 rearwardly to tension the arms 184,186, and can then release the connector section to roll the ball 176 along the playing surface (not shown).

In the illustrated game, the rescuing figure 72 are preferably associated with one of the projectiles, and the player selects the most desirable arm configuration of the launcher 171. In particular, figure 72*e* is preferably associated with use of the launcher 171 in the throwing configurations to throw the ball 176 (see FIG. 9*a*). F*igure* 72*a* is preferably associated with use of the launcher 171 in the rolling configuration to roll the ball 176 (see FIG. 9*b*). figure 72*c* is preferably associated with use of the launcher 171 in the throwing configurations to throw the grapple 180 (see FIG. 9*c*). F*igure* 72*b* is preferably associated with use of the launcher 171 in the throwing configurations to throw the net 178 (see FIG. 9*d*). It is also within the ambit of the present invention where the game assembly 30 is alternatively configured so that the rescuing figure 72 can use alternative projectiles 170, e.g., where figure 72*b* is permitted under game rules to throw the ball 176 or the net 178.

Turning to FIGS. 1 and 2, the dice 172 preferably include a large die 214 and a small die 216 located within the large die 214. The large die 214 is preferably transparent so that the rolled dice 172 can be read at the same. However, it is also within the ambit of the present invention where the die 214, 216 are separate from one another. As used herein, the term "die" refers to a polyhedral object having a cube shape or a non-cube shape. Each die 214,216 preferably has twelve sides 218*a,b*, with numeral indicia 220*a,b* from one (1) to twelve (12) each being located on a respective side 218*a,b*. However, the die 214,216 could have an alternative number of sides and/or alternative indicia on the sides without departing from the scope of the present invention.

Turning to FIGS. 13-15*f*, the activity card set 174 includes a plurality of individual cards, such as cards 222,224,226, 228,230,232, that provide challenge questions for the player to answer. The cards 222,224,226,228,230,232 each present respective problem indicia 222*a*,224*a*,226*a*,228*a*,230*a*,232*a* on one side thereof. The problem indicia includes text in the form of a question and a diagram associated with the question, although the problem indicia may include only text. The cards 222,224,226,228,230,232 also present respective answer indicia 222*b*,224*b*,226*b*,228*b*,230*b*,232*b* on the opposite side of the card. The answer indicia includes label indicia in the form of "solution" and/or "advanced solution." The answer indicia also includes text and/or diagram indicia in the form of an answer. The cards 222,224,226,228,230,232 also present label indicia 234 on the same side of the card as the answer indicia.

Game Play

As mentioned above, the object of the game is to free the captured figure 70 from the control of the holding figure 64. The rescuing figure 72 are each intended for use in freeing the captured figure 70. However, the holding figure 64 can disable a rescuing figure 72 attempting to free the captured figure 70. As mentioned, figure 72*e* is associated with use of the launcher 171 in the throwing configurations to throw the ball 176. F*igure* 72*a* is associated with use of the launcher 171 in the rolling configuration to roll the ball 176. F*igure* 72*c* is associated with use of the launcher 171 in the throwing configurations to throw the grapple 180. F*igure* 72*b* is associated with use of the launcher 171 in the throwing configurations to throw the net 178.

Again, while the components discussed above comprise a physical embodiment of the game, it is within the scope of the present invention where the game components are either partly or entirely virtual. Moreover, the game steps described herein, while disclosed as being performed by the physical embodiment of the game, could partly or entirely be performed in a virtual game space.

All of the rescuing figure 72 start the game outside of the game area (i.e., game spaces 168) in a safe area (not shown). The player is permitted to take multiple turns. For each turn, the first step is to move one or more of the squad members 66. This is done by moving a rescuing figure 72 from the safe area to the distal game space 168*k* and/or moving one or more squad members 66, within the game space area, one space in either the proximal direction or the distal direction. The second step of each turn involves an action step where the player selects one rescuing figure 72 in the game space area and uses the rescuing figure 72 to act against the holding figure 64.

The third step of each turn involves a dice roll step where the player rolls the dice 172. In response to the dice roll, the holding figure 64 may be directed to take retaliatory action against squad members 66 in the game spaces 168. Generally, the numeral indicia 220*a* of twelve ("12") on the large die 214 is associated with retaliatory action by the holding figure 64. Thus, a roll of twelve (12) on the large die 214 generally results in the retaliatory action where any squad members 66 in the game spaces 168 are rendered disabled so that the disabled squad members 66 can not be advanced in a subsequent turn, unless the squad members 66 are later revived. Disabled squad members 66 are represented in the game spaces 168 by turning the figure from a standing position to a lying position (e.g., figure 72*a* as shown in FIG. 4).

The retaliatory action is preferably prevented under several circumstances: (1) if a roll of twelve (12) also occurs on the small die 216, (2) if the holding figure 64 is disabled by being covered by the net 178 (i.e., the holding figure 64 is in a netted condition) prior to the roll, or (3) if the holding figure 64 is disabled by being toppled, unless the number roll of the small die 216 is a nine (9) or smaller.

The opportunity for retaliatory action is preferably expanded in one circumstance. In particular, when the grapple 180 is caught by the collar 82, the holding figure 64 can retaliate if the number roll of the large die 214 is a ten (10), eleven (11), or twelve (12). However, it is also within the scope of the present invention where retaliation results from an alternative number or numbers rolled by the dice.

For some aspects of the present invention, the retaliation step could be controlled by an action of the game other than a dice roll. For instance, the retaliation step could include the step of the holding figure 64 throwing an object at one or more of the rescuing figures to topple the figures. For example, the game could include an object resembling a bomb, where the bomb includes one or more spring-loaded pieces. In such an embodiment, the spring-loaded pieces could be constructed to quickly but safely separate from one another when the bomb is thrown and strikes the playing surface. Alternatively, the retaliation step could include a step where the player draws a card that determines if the holding figure 64 can retaliate against squad members during that turn or a subsequent turn.

Generally, a doubles roll (i.e., where the same numeral indicia 220 is rolled by both die 214,216) is associated with revival of figures in the game area. Thus, the doubles roll results in revival of the holding figure 64 and any squad members 66 in the game spaces 168 if any of such figures are disabled prior to the roll. Revival of figure 64 is represented by removing the net 178 if the figure 64 is netted or standing the figure 64 upright if the figure 64 is toppled. Revival of a squad member 66 is represented by turning the figure from the lying position to the standing position.

If any one of the figure 72 arrives at the proximal game space 168*a*, the dice roll can result in the release of the captured figure 70. In particular, if the number rolled by the small die 216 is larger than the number rolled by the large die 214, the figure 72 in the proximal space 168*a* is considered to have "out-rolled" the holding figure 64, and the captured figure 70 is released by the figure 72 in the proximal space 168*a*.

If figure 72*e* is selected, the player performs the second step by positioning the launcher 171 in the same game space 168 as the figure 72*e* and using the launcher 171 in one of the throwing configurations to throw the ball 176. The thrown ball 176 preferably must strike the target end 112 in front of the torso 84 to open the door 86 and release the captured figure 70. It is also possible that the thrown ball 176 topples the holding figure 64. Thus, there are several results from the thrown ball 176: 1) the door 86 is not opened and the holding figure 64 remains upright, 2) the door 86 is not opened and the holding figure is toppled, or 3) the door 86 is opened. For Result 1, the thrown ball 176 is returned to the rescuing squad and the next turn commences. For Result 2, if the target was not struck, the holding figure 64 is placed upright, the thrown ball 176 is again returned to the rescuing squad, and the next turn commences. If the target was struck and the door 86 did not open, the ball 176 can be returned so that the figure 72*e* can throw the ball 176 at the target in the next turn. Alternatively, the figure 72*e* can be advanced to the holding figure 64 in subsequent turns and can open the door by out-rolling the holding figure 64 at that time. For Result 3, the captured figure 70 is released and is positioned in the proximal game space 168*a* with the holding figure 64. The game then proceeds to the dice roll of step three, where the dice roll may direct the holding figure 64 to retaliate against squad members 66 in the game area (such as the released figure 70 and the figure 72*e*), as discussed above.

If figure 72*a* is selected, the player performs the second step by positioning the launcher 171 in the same game space 168 as the figure 72*a* and using the launcher in the rolling configuration to roll the ball 176. The rolled ball 176 preferably must strike the target end 150 in front of the leg 76*b* to topple the holding figure 64. The rolled ball 176 results in either the holding figure 64 remaining upright or being toppled. If the holding figure 64 is not toppled, the ball is returned and the game proceeds to the dice roll of step three. If the holding figure 64 is toppled and thereby disabled, the dice roll still proceeds. However, as mentioned above, the disabled holding figure 64 cannot retaliate based upon the dice roll, unless the number rolled by the large die 214 is a twelve (12) and the number rolled by the small die 216 is a nine (9) or smaller number.

If figure 72*c* is selected, the player performs the second step by positioning the launcher 171 in the same game space 168 as the figure 72*c* and using the launcher 171 in the throwing configurations to throw the grapple 180. The grapple 180 preferably must be thrown so that the grapple hook lands in or is otherwise caught by the collar 82. If the grapple 180 is not caught by the collar 82, the grapple 180 is returned to the figure 72*c* and the game proceeds to the dice roll of step three. If the grapple 180 is caught by the collar 82, the figure 72*c* is advanced to the proximal game space 168*a*. The game then proceeds to the dice roll. As discussed, the captured figure 70 can be released by the figure 72*c* if the figure 72*c* located in the proximal space 168*a* out-rolls the holding figure 64. As part of this roll, or a subsequent roll, the holding figure 64 can retaliate if the number roll of the large die 214 is a ten (10), eleven (11), or twelve (12). If doubles are rolled, the grapple 180 is removed.

If figure 72*b* is selected, the player performs the second step by positioning the launcher 171 in the same game space 168 as the figure 72*b* and using the launcher 171 in the throwing configurations to throw the net 178. The net 178 preferably must be thrown so that the net 178 covers eyes 236 of the head 80. If the net 178 does not cover the eyes 236, the net 178 is returned to the figure 72*b* and the game proceeds to the dice roll of step three. If the net 178 does cover the eyes 236, the game proceeds to the dice roll, but no retaliation is permitted until doubles are rolled and the net 178 is removed.

If figure 72*d* is selected, the player preferably first performs the step of rolling the dice 172. If the number roll of the small die 216 is ten (10), eleven (11), or twelve (12) and is larger than the number roll of the large die 214, the player is directed to the next step of selecting a card from the card set 174 and answering the challenge question. If the challenge is answered correctly, the door 86 is allowed to open so that the captured figure 70 can be positioned with the holding figure 64 in the proximal game space 168*a*. If the challenge is answered incorrectly, the game proceeds with the next turn. When the figure 72*d* moves to within three spaces of the proximal game space 168*a*, the player can automatically draw and answer a challenge card regardless of the rolled numbers.

At various times during the game, the player can move multiple rescuing figure 72 into and out of the game area. For instance, if figure 72*a* is in the game area and has been disabled (so that the figure 72 cannot be moved), another figure (e.g., figure 72*e*) can be moved into the game area (see FIG. 4). The player can move anywhere from one rescuing figure 72 to all of the rescuing figure 72 into the game area.

As discussed, the illustrated game is preferably played as a one-player game. However, it is also within the scope of the present invention where the game is played as a two-player game. In one alternative embodiment, two players can play against a single adversary. For instance, the players can each select squad members and can take turns advancing the squad members along the game spaces 168 to attempt to free the captured figure 70. In this two-player game, retaliation during one player's turn only affects the figures of that player and does not impact the figures of the other player.

In another alternative embodiment, two players can play a simulated battle against each other as part of opposing teams. For instance, each player's team has its own holding figure 64 and squad members 66. The game begins with each captured figure 70 being held by the other player's holding figure 64. The two players each take turns advancing their squad members along the game spaces 168 to attempt to free their captured figure 70. The rules discussed above for the one-player game also apply to the two-player game. Thus, the first step of a turn is for a player to move one of the squad members one space along the game space area.

For the second step of the turn, any figure of one team in the game space area can attack any figure of the other team in the game space area, including the holding figure 64. A thrown or rolled ball that topples a squad member, even a squad member from the same team, renders the squad member disabled. The third step of the turn involves a dice roll by both players. If the sum of the numbers on the dice 172 for the attacking team is greater than the sum of the numbers on the dice 172 for the opposing team (i.e., the attacking team out-rolls the opposing team), the disabled squad member remains disabled. Otherwise, the disabled squad member is revived and is free to move.

During the second step, if the net is thrown by a player's squad member and covers an opposing squad member, the opposing squad member is disabled and is positioned in the game space of the player's holding figure. The third step of the turn then involved a dice roll by both players. If the attacking team out-rolls the opposing team, the disable squad member remains disabled. Otherwise, the disabled squad member is revived and is free to move.

Alternative Holding Figure

Turning to FIGS. 16-18, an alternative game assembly 300 is constructed in accordance with a second embodiment of the present invention. The game assembly 300 includes an alternative holding figure 302 that is operable to control a captured figure (not shown) and release the captured figure when struck by an object. The holding figure 302 includes, among other things, a torso 304, left and right arm assemblies 306, 308, and a head 310. The illustrated torso 304 is preferably unitary and supports the arm assemblies 306,308 and head 310.

The arm assemblies 306,308 cooperatively define a chamber 312 for holding the captured figure, similar to the chamber of the previous embodiment. The left arm assembly 306 includes upper and lower arm sections 314,316 and a latch assembly 318. The upper arm section 314 is elongated and includes proximal and distal ends, with the distal end being slotted. The proximal end of the upper arm section 314 is fixed to the torso 304. The lower arm section 316 is elongated and includes a forearm 320 and a left hand 322. A proximal male end of the lower arm section 316 is pivotally received within the slot presented by the slotted distal end of the upper arm section 314 and is pivotally attached thereto so as to form a joint 324. In particular, corresponding ends of arm sections 314,316 are secured to each other with a pin 326 and a torsion spring 328 that urges the lower arm section 316 to swing from a closed position (see FIGS. 16*a* and 18*b*) to an open position (see FIGS. 16*b* and 18*a*). However, the principles of the present invention are applicable where the joint 324 is alternatively constructed, e.g., where the joint 324 comprises a ball-and-socket joint.

Similarly, the right arm assembly 308 includes upper and lower arm sections 330,332 that are pivotally attached to one another at a spring-loaded joint, which has a similar construction to the joint of the left arm, that urges the lower arm section 332 to swing from a closed position (see FIG. 16*a*) to an open position (see FIG. 16*b*). The lower arm section 332 includes a right hand 334. When the lower arm sections 316,332 are closed, the hands 322,334 are in a closed condition and form the chamber 312. When in the closed condition, the hands 332,334 cooperatively restrict ingress and egress of the captured figure relative to the chamber 312. In the illustrated embodiment, the right hand 334 is positioned generally above the left hand. Additionally, three fingers (i.e., the index, middle, and ring fingers) of the right hand 334 are preferably positioned between the index finger and thumb of the left hand 322, while three fingers (i.e., the middle, ring, and little fingers) of the left hand 322 are positioned between the little finger and thumb of the right hand 334. When the lower arm sections 316,332 are open, the hands 322,334 are in an open condition and permit figure ingress and egress relative to the chamber 312. While both lower arms sections 316,332 pivot relative to the upper arm sections 314,330, it is also within the scope of the present invention where only one of the right and left arms has a pivotal lower arm section.

The latch assembly 318 serves to hold the lower arm sections 316,332 closed, and thereby keeps the chamber 312 closed, until the latch assembly 318 is struck by an object. The latch assembly 318 includes an elongated latch 336 and a pin 338. The latch 336 includes a body with a target end 340 and a latch end 342 that includes a projection 344. The latch body presents a hole 346 between the ends 340,342, and the hole 346 rotatably receives the pin 338.

The hand 322 presents slotted openings 348,350 that preferably extend along a thumb of the hand 322. The latch 336 is attached to the hand 322 by inserting the latch body in the opening 348 and the projection 344 in the opening 350. Thus, the latch 336, including the target, can swing between a latching position, where the projection 344 is retracted into the opening 350 (see FIG. 17*a*) and an open position, where the projection 344 is located out of the opening 350 (see FIG. 17*b*).

With the hands 322,334 in the closed position, a shoulder 352 presented by the right index finger of the right hand 334 engages a shoulder 354 presented by the left thumb of the left hand 322 (see FIG. 17*a*). The shoulders 352,354 cooperatively restrict pivotal movement of the lower arm sections 316,332 out of the closed position, while the latch 336 is retracted. As the latch 336 is swung from the retracted position to the extended position, e.g., when an object strikes the target end 340, the projection 344 urges the shoulders 352, 354 out of engagement. In this manner, the hands 322,334 become disengaged so that the lower arm sections 316,322 are urged by the spring-loaded joints into the open position.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A game assembly comprising:

a holding figure including a body and a door that cooperatively present a chamber;

a captured figure removably positioned in the chamber, said body and door being shiftable relative to one another so that the door shifts open and closed relative to the body, said body and door cooperatively preventing the figure from being positioned in or removed from the chamber when the door is closed and permitting the figure to be positioned in or removed from the chamber when the door is open, said holding figure including a door spring that yieldably urges the door open, said holding figure further including a latch assembly shiftable into and out of a latching position where the latch assembly releasably secures the door closed, said latch assembly including a latch shiftably attached to the body, said latch assembly further including a latch spring yieldably biasing the latch into latching engagement with the door to secure the door closed when the latch assembly is in the latching condition, with the door being automatically opened by the door spring when the latch assembly is shifted out of the latching position to disengage the latch from the door, said latch assembly including a target shiftably mounted to the holding figure, with the target releasing the latch assembly from the latching position when actuated so as to permit the door to open, said target being operably connected to the latch, with shifting of the target causing the latch to disengage the door so that the door is urged open;

a projectile used to strike and thereby shift the target; and a projectile launcher spaced from the target in opposition thereto, with the launcher operable to propel the projectile into striking engagement with the target and thereby shift the target.

2. The game assembly as claimed in claim 1, said target being fixed relative to the latch so as to shift therewith.

3. The game assembly as claimed in claim 1, said holding figure presenting the form of an animate creature and including a torso, with the body comprising the torso.

4. The game assembly as claimed in claim 3, said door being shiftably mounted to the torso.

5. The game assembly as claimed in claim 4, said latch being shiftably attached to the torso.

6. The game assembly as claimed in claim 3, said holding figure including a leg operable to support the holding figure in an upright position.

7. The game assembly as claimed in claim 6, said holding figure including a trigger assembly shiftably attached relative to the leg, said trigger assembly removably securing the leg in a supporting condition to hold the holding figure in the upright position, said trigger assembly being shiftable to remove the leg from the supporting condition and thereby permit the holding figure to topple over.

8. The game assembly as claimed in claim 1, said holding figure presenting the form of an animate creature and including a torso, with the body and door each comprising an arm, said arms being pivotally mounted relative to the torso to pivot between the open and closed conditions.

9. The game assembly as claimed in claim 1, said projectile being selected from the group consisting of a ball, a net, and a grapple assembly.

* * * * *